US007481592B2

(12) United States Patent
Gueret

(10) Patent No.: US 7,481,592 B2
(45) Date of Patent: Jan. 27, 2009

(54) METHOD OF APPLYING MAKEUP BY MEANS OF A VIBRATING APPLICATOR

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 11/793,015

(22) PCT Filed: Feb. 24, 2006

(86) PCT No.: PCT/IB2006/050595

§ 371 (c)(1),
(2), (4) Date: Oct. 22, 2007

(87) PCT Pub. No.: WO2006/090343

PCT Pub. Date: Aug. 31, 2006

(65) Prior Publication Data

US 2008/0138138 A1 Jun. 12, 2008

Related U.S. Application Data

(60) Provisional application No. 60/664,178, filed on Mar. 23, 2005.

(30) Foreign Application Priority Data

Feb. 25, 2005 (FR) ..... 05 50526

(51) Int. Cl.
*A46B 11/00* (2006.01)
*A46B 17/08* (2006.01)

(52) U.S. Cl. ..... 401/129; 401/126; 401/122

(58) Field of Classification Search ..... 401/118, 401/121, 122, 126–130
See application file for complete search history.

(56) References Cited

U.S. PATENT DOCUMENTS

| | | | |
|---|---|---|---|
| 1,905,399 | A | 4/1933 | Wagner |
| 2,131,539 | A | 9/1938 | Mureau |
| 2,379,049 | A | 6/1945 | Tompkins |
| 3,030,647 | A | 4/1962 | Peyron |
| 3,358,309 | A | 12/1967 | Richardson |
| 3,754,548 | A | 8/1973 | Mcgrath |

(Continued)

FOREIGN PATENT DOCUMENTS

DE 86 03 383 U1 9/1986

(Continued)

OTHER PUBLICATIONS

Begoun, Paula. "The Beauty Bible," 2nd. ed., Jun. 2002, Beginning Press, ISBN 1-877988-29-4. pp. 448-451.

(Continued)

*Primary Examiner*—David J Walczak
(74) *Attorney, Agent, or Firm*—Oblon, Spivak, McClelland, Maier & Neustadt, P.C.

(57) ABSTRACT

An applicator for applying a makeup composition. The applicator includes an applicator element configured to apply the makeup composition to one of nails, eyelashes, eyebrows, skin and lips, and a vibration source causing the applicator element to vibrate. The applicator is configured to be fastened onto a receptacle containing the composition to be applied, and/or further comprises a reservoir containing the composition to be applied.

23 Claims, 11 Drawing Sheets

U.S. PATENT DOCUMENTS

| | | | | |
|---|---|---|---|---|
| 3,892,997 | A | 7/1975 | Thorington et al. | |
| 3,921,650 | A | 11/1975 | Montgomery | |
| 4,011,616 | A | 3/1977 | Kennedy | |
| 4,056,111 | A | 11/1977 | Mantelet | |
| 4,123,816 | A * | 11/1978 | Lupo | 15/88.3 |
| 4,397,326 | A | 8/1983 | Formica | |
| 4,428,388 | A | 1/1984 | Cassai et al. | |
| 4,545,393 | A | 10/1985 | Gueret et al. | |
| 4,561,456 | A | 12/1985 | Gueret | |
| 4,586,520 | A | 5/1986 | Brittain | |
| 4,602,651 | A | 7/1986 | Roppatte, Jr. | |
| 4,603,448 | A | 8/1986 | Middleton et al. | |
| 4,605,022 | A | 8/1986 | Gueret | |
| 4,632,136 | A | 12/1986 | Kingsford | |
| 4,733,425 | A | 3/1988 | Hartel et al. | |
| 4,796,647 | A | 1/1989 | Gueret | |
| 4,845,796 | A | 7/1989 | Mosley | |
| 4,850,727 | A | 7/1989 | Gueret | |
| 4,861,179 | A | 8/1989 | Schrepf et al. | |
| 4,887,622 | A | 12/1989 | Gueret | |
| 4,889,228 | A | 12/1989 | Gueret | |
| 4,898,193 | A | 2/1990 | Gueret | |
| 4,914,988 | A | 4/1990 | Chang | |
| 4,922,934 | A | 5/1990 | Gatti | |
| 4,927,281 | A | 5/1990 | Gueret | |
| 4,929,108 | A | 5/1990 | Gueret | |
| 4,937,326 | A | 6/1990 | Kayane et al. | |
| 4,954,000 | A | 9/1990 | Gueret | |
| 4,974,612 | A | 12/1990 | Gueret | |
| 4,974,980 | A | 12/1990 | Gueret | |
| 4,993,440 | A | 2/1991 | Gueret | |
| 5,009,534 | A | 4/1991 | Gueret | |
| 5,063,947 | A | 11/1991 | Gueret | |
| 5,078,157 | A | 1/1992 | Golan et al. | |
| 5,086,793 | A | 2/1992 | Kingsford | |
| 5,088,145 | A | 2/1992 | Whitefield | |
| 5,094,254 | A | 3/1992 | Krueckel et al. | |
| 5,096,319 | A | 3/1992 | Gueret | |
| 5,102,250 | A | 4/1992 | Gueret | |
| 5,107,870 | A | 4/1992 | Beck et al. | |
| 5,131,773 | A | 7/1992 | Gueret | |
| 5,137,038 | A | 8/1992 | Kingsford | |
| 5,165,760 | A | 11/1992 | Gueret | |
| 5,180,241 | A | 1/1993 | Gueret | |
| 5,187,827 | A | 2/1993 | Wei | |
| 5,189,751 | A | 3/1993 | Giuliani et al. | |
| 5,192,153 | A | 3/1993 | Gueret | |
| 5,197,497 | A | 3/1993 | Gueret | |
| 5,238,011 | A | 8/1993 | Gueret | |
| 5,247,218 | A | 9/1993 | Sven | |
| 5,263,218 | A | 11/1993 | Giuliani et al. | |
| 5,277,508 | A | 1/1994 | Gueret | |
| 5,299,354 | A | 4/1994 | Metcalf et al. | |
| 5,324,128 | A | 6/1994 | Gueret | |
| 5,335,465 | A | 8/1994 | Gueret | |
| 5,339,841 | A | 8/1994 | Gueret | |
| 5,345,644 | A | 9/1994 | Gueret | |
| 5,357,647 | A | 10/1994 | Gueret | |
| 5,357,987 | A | 10/1994 | Schrepf | |
| 5,370,141 | A | 12/1994 | Gueret | |
| 5,476,384 | A | 12/1995 | Giuliani et al. | |
| 5,482,059 | A | 1/1996 | Miraglia | |
| 5,492,426 | A | 2/1996 | Gueret | |
| 5,511,270 | A | 4/1996 | Eliachar et al. | |
| 5,542,439 | A | 8/1996 | Gueret | |
| 5,567,072 | A | 10/1996 | Dunleavy et al. | |
| 5,588,447 | A | 12/1996 | Gueret | |
| 5,588,450 | A | 12/1996 | Gueret | |
| 5,595,198 | A | 1/1997 | Kemmerer | |
| 5,620,270 | A | 4/1997 | Gueret | |
| 5,622,192 | A | 4/1997 | Chiou | |
| 5,651,157 | A | 7/1997 | Hahn | |
| 5,716,150 | A | 2/1998 | Gueret | |
| 5,718,667 | A | 2/1998 | Sugimoto et al. | |
| 5,743,279 | A | 4/1998 | Gueret | |
| 5,761,760 | A | 6/1998 | Dumler et al. | |
| 5,765,573 | A | 6/1998 | Gueret | |
| 5,772,347 | A | 6/1998 | Gueret | |
| 5,775,344 | A | 7/1998 | Clay | |
| 5,794,632 | A | 8/1998 | Gueret | |
| 5,816,728 | A | 10/1998 | Nardolillo et al. | |
| 5,836,320 | A | 11/1998 | Gueret | |
| 5,853,011 | A | 12/1998 | Gueret | |
| 5,860,432 | A | 1/1999 | Gueret | |
| 5,876,138 | A | 3/1999 | Gueret | |
| 5,879,095 | A | 3/1999 | Gueret | |
| 5,888,005 | A | 3/1999 | Gueret | |
| 5,890,828 | A | 4/1999 | Gueret | |
| 5,894,847 | A | 4/1999 | Gueret | |
| 5,899,622 | A | 5/1999 | Gueret | |
| 5,913,318 | A | 6/1999 | Gueret | |
| 5,918,994 | A | 7/1999 | Gueret | |
| 5,934,292 | A | 8/1999 | Gueret | |
| 5,937,870 | A | 8/1999 | Gueret | |
| 5,937,871 | A | 8/1999 | Clay | |
| 6,012,465 | A | 1/2000 | Gueret | |
| 6,026,823 | A | 2/2000 | Gueret | |
| 6,026,824 | A | 2/2000 | Gueret | |
| 6,033,143 | A | 3/2000 | Gueret | |
| 6,059,473 | A | 5/2000 | Gueret | |
| 6,067,997 | A | 5/2000 | Gueret | |
| 6,070,598 | A | 6/2000 | Gueret | |
| 6,073,634 | A | 6/2000 | Gueret | |
| 6,076,531 | A | 6/2000 | Gueret | |
| 6,081,702 | A | 6/2000 | Serfaty et al. | |
| 6,082,999 | A | 7/2000 | Tcherny et al. | |
| 6,139,553 | A | 10/2000 | Dotan | |
| 6,145,514 | A | 11/2000 | Clay | |
| 6,176,631 | B1 | 1/2001 | Gueret | |
| 6,178,579 | B1 | 1/2001 | Blaustein et al. | |
| 6,220,254 | B1 | 4/2001 | Gueret | |
| 6,237,609 | B1 | 5/2001 | Vasas | |
| 6,280,113 | B1 | 8/2001 | Gueret | |
| 6,289,902 | B1 | 9/2001 | Mathiez | |
| 6,295,994 | B1 | 10/2001 | Thayer et al. | |
| 6,305,861 | B1 | 10/2001 | Gueret | |
| 6,328,495 | B1 | 12/2001 | Gueret | |
| 6,343,607 | B1 | 2/2002 | Gueret | |
| 6,345,626 | B1 | 2/2002 | Bouix | |
| 6,375,374 | B2 | 4/2002 | Gueret | |
| 6,386,781 | B1 | 5/2002 | Gueret | |
| 6,390,708 | B1 | 5/2002 | Gueret | |
| 6,412,496 | B1 | 7/2002 | Gueret | |
| 6,453,498 | B1 | 9/2002 | Wu | |
| 6,474,890 | B1 | 11/2002 | Gueret | |
| 6,494,215 | B2 | 12/2002 | Gueret | |
| 6,539,950 | B1 | 4/2003 | Gueret | |
| 6,546,937 | B2 | 4/2003 | Gueret | |
| 6,565,276 | B1 | 5/2003 | Diaz | |
| 6,581,610 | B1 | 6/2003 | Gueret | |
| 6,591,842 | B2 | 7/2003 | Gueret | |
| 6,623,200 | B1 | 9/2003 | Gueret | |
| 6,634,821 | B2 | 10/2003 | Gueret | |
| 6,655,390 | B2 | 12/2003 | Gueret | |
| 6,662,810 | B2 | 12/2003 | Gueret | |
| 6,666,607 | B2 | 12/2003 | Gueret | |
| 6,675,814 | B2 | 1/2004 | Gueret | |
| 6,681,777 | B2 | 1/2004 | Gueret | |
| 6,682,244 | B2 | 1/2004 | Gueret | |
| 6,688,317 | B2 | 2/2004 | Gueret | |
| 6,691,716 | B2 | 2/2004 | Neuner et al. | |
| 6,814,084 | B2 | 11/2004 | Gueret | |
| 6,948,209 | B2 | 9/2005 | Chan | |
| 7,069,936 | B2 | 7/2006 | Gueret | |

| | | | |
|---|---|---|---|
| 7,075,858 | B2 | 7/2006 | Doisy et al. |
| 7,121,284 | B2 | 10/2006 | Gueret |
| 7,156,105 | B2 | 1/2007 | Gueret |
| 7,171,969 | B2 | 2/2007 | Gueret |
| 7,409,741 | B2 | 8/2008 | Dworzan |
| 2002/0023658 | A1 | 2/2002 | Gueret |
| 2002/0084707 | A1 | 7/2002 | Tang |
| 2002/0116774 | A1 | 8/2002 | Forrest |
| 2002/0124860 | A1 | 9/2002 | Gueret |
| 2002/0168214 | A1 | 11/2002 | Carullo et al. |
| 2002/0182409 | A1 | 12/2002 | Gueret |
| 2003/0089379 | A1 | 5/2003 | Gueret |
| 2004/0168698 | A1 | 9/2004 | Gueret |
| 2004/0182410 | A1 | 9/2004 | Gueret |
| 2005/0011532 | A1 | 1/2005 | Gueret |
| 2005/0031401 | A1 | 2/2005 | Gueret |
| 2005/0034740 | A1 | 2/2005 | Eckers et al. |
| 2005/0150509 | A1 | 7/2005 | Gueret |
| 2005/0232681 | A1 | 10/2005 | Gueret |
| 2005/0238409 | A2 | 10/2005 | Gueret |
| 2005/0271454 | A1 | 12/2005 | Gueret |
| 2005/0286966 | A1 | 12/2005 | Gueret |
| 2006/0002758 | A1 | 1/2006 | Gueret |
| 2006/0013639 | A1 | 1/2006 | Gueret |
| 2006/0032512 | A1 | 2/2006 | Kress et al. |
| 2006/0272666 | A1 | 12/2006 | Wyatt et al. |
| 2006/0272667 | A1 | 12/2006 | Wyatt et al. |
| 2006/0272668 | A1 | 12/2006 | Wyatt et al. |
| 2008/0138138 | A1 | 6/2008 | Gueret |

FOREIGN PATENT DOCUMENTS

| | | | |
|---|---|---|---|
| DE | 3 828 001 | A1 | 3/1989 |
| DE | 3 835 843 | A1 | 4/1990 |
| DE | 197 44 181 | A1 | 4/1999 |
| DE | 19950665 | A1 | 5/2000 |
| DE | 101 02 219 | A1 | 7/2002 |
| DE | 20309943 | U1 | 9/2003 |
| EP | 0 250 680 | A1 | 1/1988 |
| EP | 0 289 726 | A2 | 11/1988 |
| EP | 0511842 | | 11/1992 |
| EP | 1 050 236 | A1 | 11/2000 |
| EP | 1 417 909 | A1 | 5/2004 |
| FR | 2 860 770 | A | 10/1939 |
| FR | 2 363 299 | A1 | 3/1978 |
| FR | 2 412 287 | A1 | 7/1979 |
| FR | 2 486 375 | A1 | 1/1982 |
| FR | 2 490 470 | A1 | 3/1982 |
| FR | 2 500 730 | A1 | 3/1982 |
| FR | 2 505 633 | A1 | 11/1982 |
| FR | 2 506 581 | A1 | 12/1982 |
| FR | 2 518 381 | A1 | 6/1983 |
| FR | 2 529 765 | A1 | 1/1984 |
| FR | 2 544 970 | A1 | 11/1984 |
| FR | 2 562 773 | A1 | 10/1985 |
| FR | 2 581 569 | A1 | 11/1986 |
| FR | 2 585 934 | A1 | 2/1987 |
| FR | 2 588 733 | A1 | 4/1987 |
| FR | 2 603 780 | A1 | 3/1988 |
| FR | 2 605 505 | A1 | 4/1988 |
| FR | 2 607 372 | A1 | 6/1988 |
| FR | 2 607 373 | A1 | 6/1988 |
| FR | 2 625 083 | A1 | 6/1989 |
| FR | 2 627 068 | A1 | 8/1989 |
| FR | 2 627 363 | A1 | 8/1989 |
| FR | 2 633 167 | A1 | 12/1989 |
| FR | 2 633 256 | A1 | 12/1989 |
| FR | 2 633 498 | A1 | 1/1990 |
| FR | 2 637 471 | A1 | 4/1990 |
| FR | 2 637 472 | A1 | 4/1990 |
| FR | 2 642 675 | A1 | 8/1990 |
| FR | 2 642 676 | A1 | 8/1990 |
| FR | 2 648 686 | A1 | 12/1990 |
| FR | 2 650 162 | A1 | 2/1991 |
| FR | 2 662 921 | A1 | 12/1991 |
| FR | 2 663 823 | A1 | 1/1992 |
| FR | 2 663 826 | A1 | 1/1992 |
| FR | 2 668 903 | A1 | 5/1992 |
| FR | 2 668 905 | A1 | 5/1992 |
| FR | 2 675 355 | A1 | 10/1992 |
| FR | 2 679 113 | A1 | 1/1993 |
| FR | 2 685 859 | A1 | 7/1993 |
| FR | 2 685 925 | A1 | 7/1993 |
| FR | 2 686 491 | A1 | 7/1993 |
| FR | 2 687 055 | A1 | 8/1993 |
| FR | 2 730 910 | A1 | 8/1993 |
| FR | 2 690 318 | A1 | 10/1993 |
| FR | 2 733 398 | A1 | 10/1993 |
| FR | 2 701 198 | A1 | 8/1994 |
| FR | 2 701 818 | A1 | 9/1994 |
| FR | 2 711 898 | A1 | 5/1995 |
| FR | 2 715 038 | A1 | 7/1995 |
| FR | 2 717 057 | A1 | 9/1995 |
| FR | 2 722 380 | A1 | 1/1996 |
| FR | 2 722 381 | A1 | 1/1996 |
| FR | 2 724 095 | A1 | 3/1996 |
| FR | 2 727 608 | A1 | 6/1996 |
| FR | 2 729 060 | A1 | 7/1996 |
| FR | 2 730 704 | A1 | 8/1996 |
| FR | 2 733 673 | A1 | 11/1996 |
| FR | 2 734 131 | A1 | 11/1996 |
| FR | 2 706 749 | A1 | 12/1996 |
| FR | 2 736 248 | A1 | 1/1997 |
| FR | 2 738 125 | A1 | 3/1997 |
| FR | 2 738 127 | A1 | 3/1997 |
| FR | 2 745 479 | A1 | 5/1997 |
| FR | 2 745 272 | A1 | 8/1997 |
| FR | 2 745 481 | A1 | 9/1997 |
| FR | 2 748 913 | A1 | 11/1997 |
| FR | 2 749 489 | A1 | 12/1997 |
| FR | 2 749 490 | A1 | 12/1997 |
| FR | 2 752 696 | A1 | 3/1998 |
| FR | 2 753 056 | A1 | 3/1998 |
| FR | 2 753 587 | A1 | 3/1998 |
| FR | 2 753 614 | A1 | 3/1998 |
| FR | 2753058 | A1 | 3/1998 |
| FR | 2 754 458 | A1 | 4/1998 |
| FR | 2 755 593 | A1 | 5/1998 |
| FR | 2 759 872 | A1 | 8/1998 |
| FR | 2 759 873 | A1 | 8/1998 |
| FR | 2 761 959 | A1 | 10/1998 |
| FR | 2 762 494 | A1 | 10/1998 |
| FR | 2 771 077 | A1 | 5/1999 |
| FR | 2 774 269 | A1 | 8/1999 |
| FR | 2 629 988 | A1 | 10/1999 |
| FR | 2 779 924 | A1 | 12/1999 |
| FR | 2 781 653 | A1 | 2/2000 |
| FR | 2 792 618 | A1 | 10/2000 |
| FR | 2 793 218 | A1 | 11/2000 |
| FR | 2 793 663 | A1 | 11/2000 |
| FR | 2 796 527 | A1 | 1/2001 |
| FR | 2 796 528 | A1 | 1/2001 |
| FR | 2 796 529 | A1 | 1/2001 |
| FR | 2 796 530 | A1 | 1/2001 |
| FR | 2 796 531 | A1 | 1/2001 |
| FR | 2 796 532 | A1 | 1/2001 |
| FR | 2 800 586 | A1 | 5/2001 |
| FR | 2 808 981 | A1 | 11/2001 |
| FR | 2 809 294 | A1 | 11/2001 |
| FR | 2 809 295 | A1 | 11/2001 |
| FR | 2 808980 | A1 | 11/2001 |
| FR | 2 809 938 | A1 | 12/2001 |
| FR | 2 810 860 | A1 | 1/2002 |
| FR | 2 810 861 | A1 | 1/2002 |
| FR | 2 811 525 | A1 | 1/2002 |
| FR | 2 812 176 | A1 | 2/2002 |

| | | | |
|---|---|---|---|
| FR | 2 814 923 | A1 | 4/2002 |
| FR | 2 815 832 | A1 | 5/2002 |
| FR | 2 821 532 | A1 | 9/2002 |
| FR | 2 821 533 | A1 | 9/2002 |
| FR | 2 821 536 | A1 | 9/2002 |
| FR | 2 825 246 | A1 | 12/2002 |
| FR | 2 825 247 | A1 | 12/2002 |
| FR | 2 830 421 | A1 | 4/2003 |
| FR | 2 831 033 | A1 | 4/2003 |
| FR | 2 836 029 | A1 | 8/2003 |
| FR | 2 836 030 | A1 | 8/2003 |
| FR | 2 836 031 | A1 | 8/2003 |
| FR | 2 836 800 | A1 | 9/2003 |
| FR | 2 837 077 | A1 | 9/2003 |
| FR | 2 838 936 | A1 | 10/2003 |
| FR | 2 839 625 | A1 | 11/2003 |
| FR | 2 840 514 | A1 | 12/2003 |
| FR | 2 840 515 | A1 | 12/2003 |
| FR | 2 840 516 | A1 | 12/2003 |
| FR | 2 845 577 | A1 | 4/2004 |
| FR | 2 847 436 | A1 | 5/2004 |
| FR | 2 850 257 | A1 | 7/2004 |
| FR | 2 850 549 | A1 | 8/2004 |
| FR | 2 851 435 | A1 | 8/2004 |
| FR | 2 851 899 | A1 | 9/2004 |
| FR | 2 852 500 | A1 | 9/2004 |
| FR | 2 852 796 | A1 | 10/2004 |
| FR | 2 854 779 | A1 | 11/2004 |
| FR | 2 855 379 | A1 | 12/2004 |
| FR | 2 855 380 | A1 | 12/2004 |
| FR | 2 858 529 | A1 | 2/2005 |
| FR | 2 860 769 | A1 | 4/2005 |
| FR | 2 863 460 | A1 | 6/2005 |
| FR | 2 866 215 | A1 | 8/2005 |
| FR | 2 868 669 | A1 | 10/2005 |
| FR | 2 869 511 | A1 | 11/2005 |
| FR | 2 870 697 | A1 | 12/2005 |
| FR | 2 871 139 | A1 | 12/2005 |
| FR | 2 872 394 | A1 | 1/2006 |
| FR | 2 872 999 | A1 | 1/2006 |
| FR | 2 874 798 | A1 | 3/2006 |
| GB | 846639 | | 8/1960 |
| JP | 44-30666 | | 12/1969 |
| JP | 53-15478 | | 4/1978 |
| JP | 53-24429 | | 6/1978 |
| JP | 64-4222 | | 1/1989 |
| JP | 1-502644 | | 9/1989 |
| JP | 6-31529 | | 4/1994 |
| JP | 3003053 | | 8/1994 |
| JP | 6-269317 | | 9/1994 |
| JP | 7-24127 | | 5/1995 |
| JP | 08-010705 | | 1/1996 |
| JP | 8-257043 | | 10/1996 |
| JP | 10-192054 | | 7/1998 |
| JP | 11-187934 | | 7/1999 |
| JP | A 2002-059121 | | 2/2002 |
| JP | 3091449 | | 11/2002 |
| JP | 2003-93415 | | 4/2003 |
| JP | A 2003-164473 | | 6/2003 |
| JP | 2004-174267 | | 6/2004 |
| JP | 2005-095531 | | 4/2005 |
| WO | WO 92/21306 | | 12/1992 |
| WO | WO 94/09679 | | 5/1994 |
| WO | WO 96/19928 | | 7/1996 |
| WO | WO 02/072042 | A2 | 9/2002 |

OTHER PUBLICATIONS

Kogyo Zairyo (Monthly Magazine on Industrial Materials) in Japanese with English Abstract in Search Report (Search Country: Japan) vol. 40 No. 7 p. 169-174. May, 1992.

* cited by examiner

Fig.10
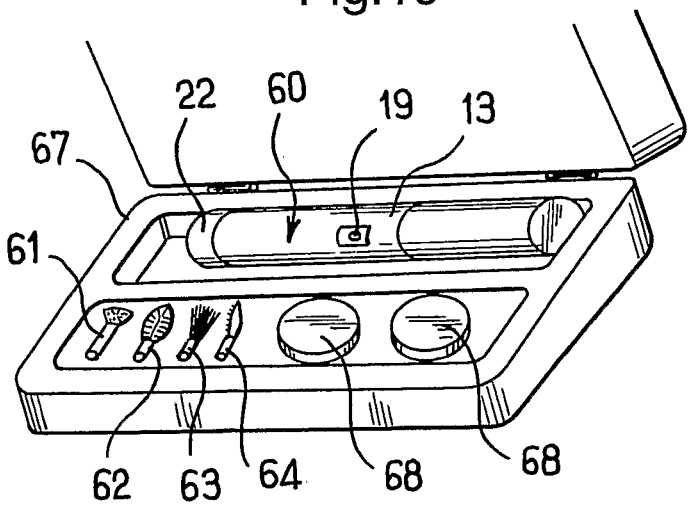
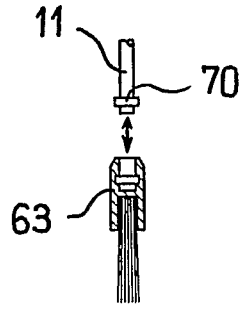
Fig.11
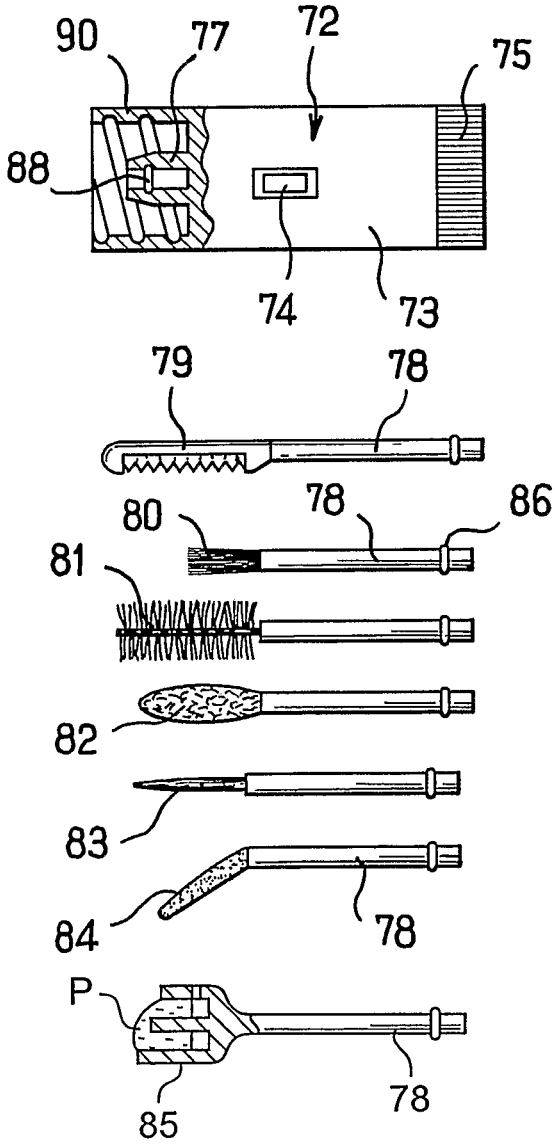
Fig.12

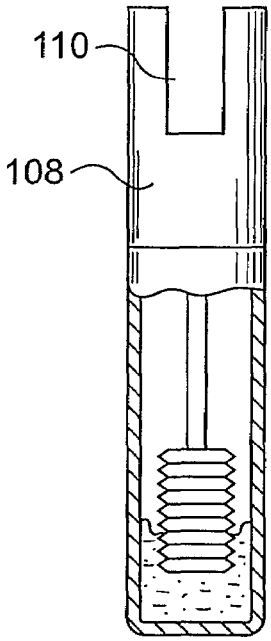
Fig.22
Fig.28
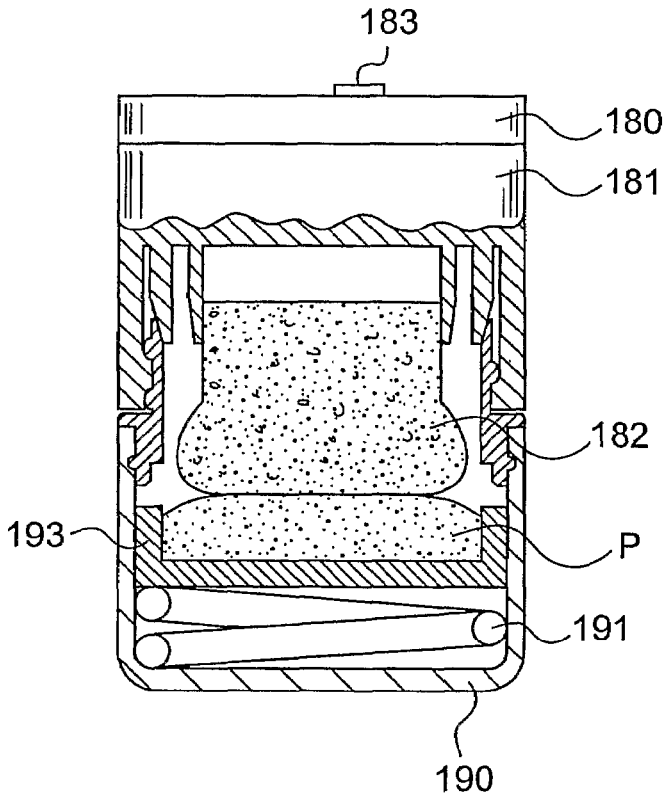
Fig.33
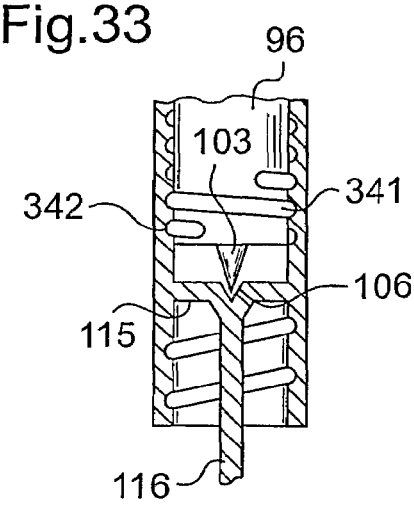
Fig.34
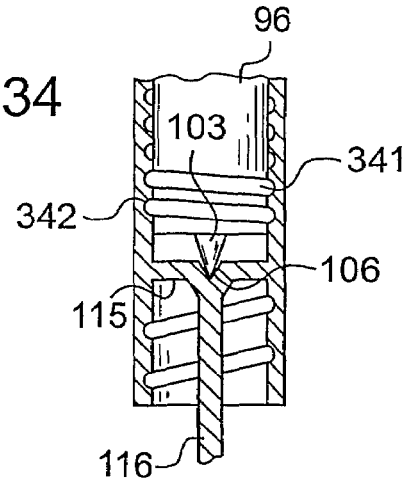

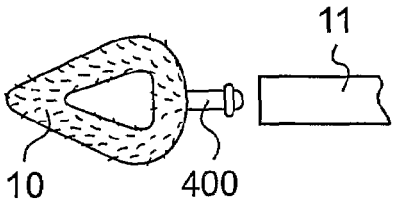
Fig.35
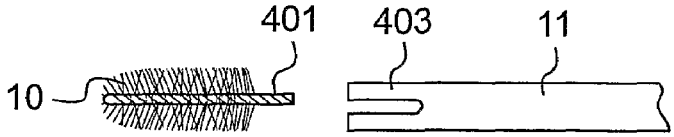
Fig.36
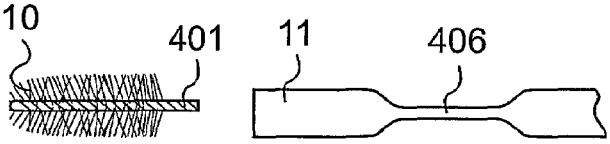
Fig.37
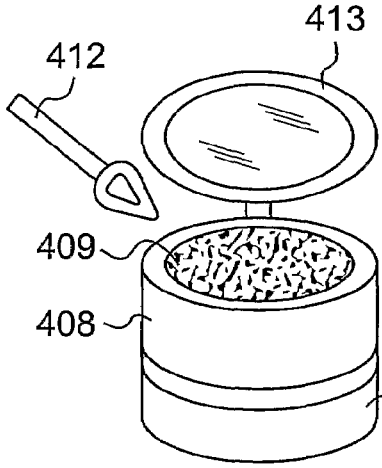
Fig.38
Fig.39
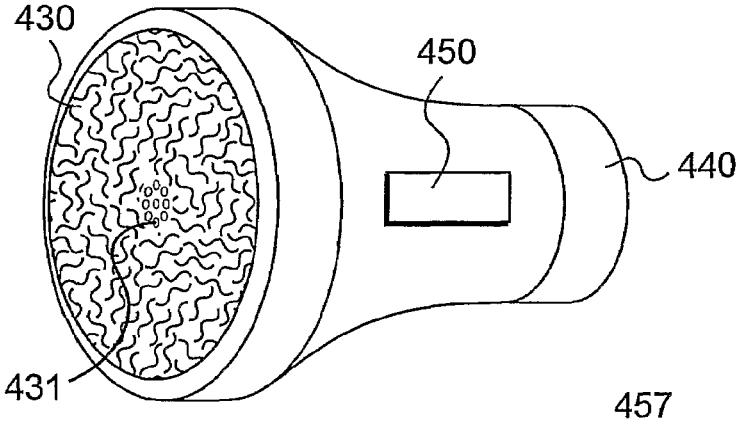
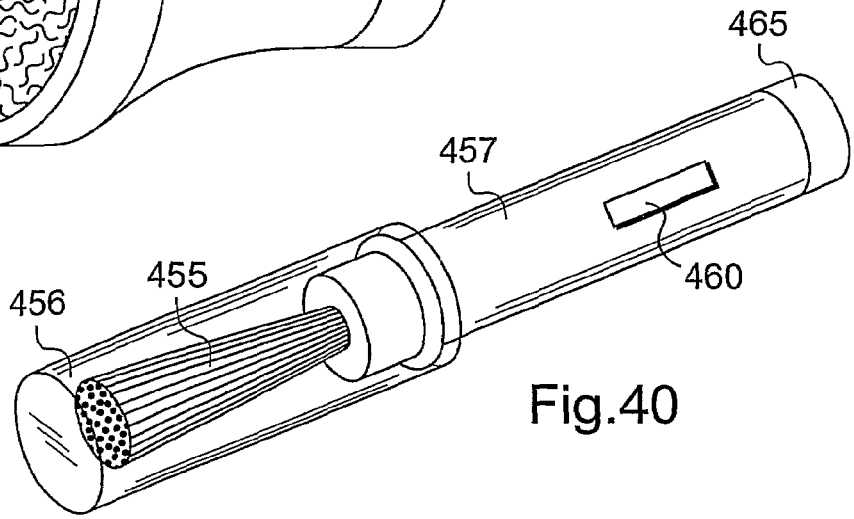
Fig.40

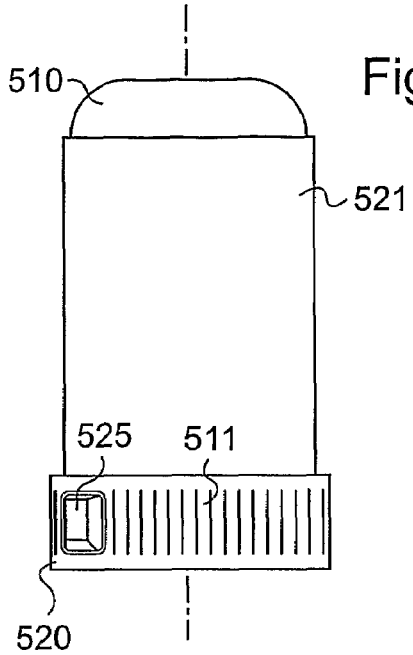
Fig.44
Fig.45
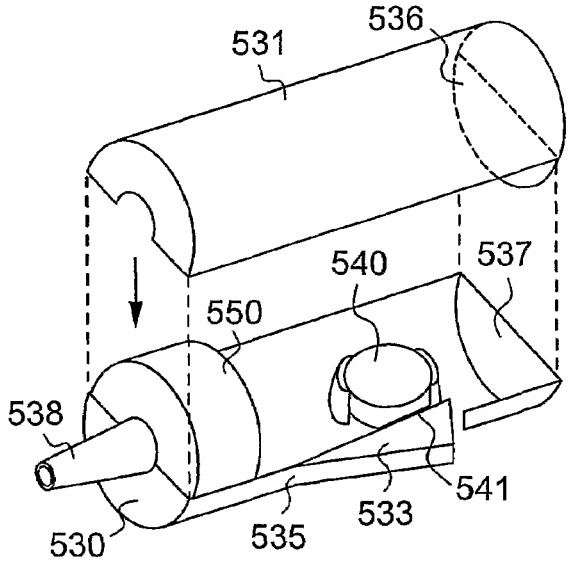
Fig.46
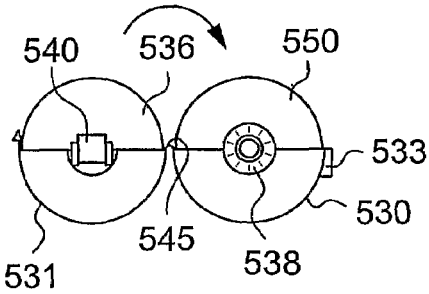
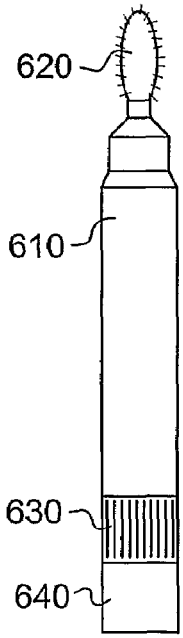
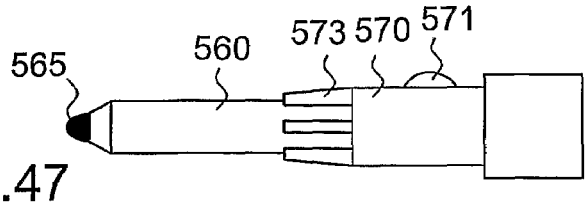
Fig.47
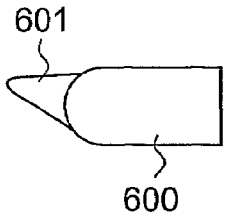
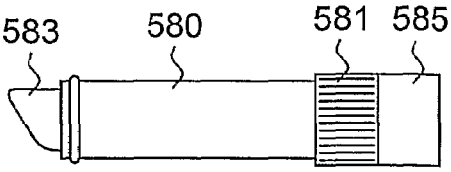
Fig.48
Fig.49

METHOD OF APPLYING MAKEUP BY MEANS OF A VIBRATING APPLICATOR

The present invention relates to methods of applying makeup, and to applicators that are used to apply a cosmetic composition, including a care product, to keratinous fibers, the skin, the lips, or the nails.

BACKGROUND

Field of Invention

Makeup can be applied to the eyelashes with applicators that include an applicator element constituted by a brush or a comb, by taking the composition to be applied from a cake of composition or from a receptacle that is provided with a wiper member.

Up to the present, the results obtained with such applicators are satisfactory, but sometimes, as a function of the rheology of the compositions, the deposited layer is not always as smooth as desired, and in particular with compositions that are viscous, the eyelashes are sometimes insufficiently separated. Furthermore, when the composition contains fibers, said fibers do not always slide easily, and are not always well-oriented along the eyelashes.

Consequently, there exists a need to improve still further the application of makeup to the eyelashes.

In addition, makeup is usually applied to the nails by means of a brush with which it can be difficult to deposit an even and relatively thick layer of composition. Unfortunately, obtaining the desired coverage and possible optical effects is often linked to the quantity of composition deposited. Finally, the bristles of the brush sometimes tend to form unattractive stripes when depositing the composition on the nail.

Consequently, there also exists a need to improve the application of makeup to the nails.

Applicators are also known that include an applicator element comprising a block of foam that is possibly supplied with composition from a supply of composition provided in the applicator. In use, by rubbing on the skin, the applicator element risks removing the composition that has already been deposited. It is thus difficult to deposit a relatively thick layer of composition with such applicators. A solution for improving deposition can consist in providing a particularly soft coating on the surface of the applicator element, e.g. flocking, but this complicates the manufacture of the applicator element.

It is also known to spray a makeup composition onto the body. However, such spraying runs the risk of dispersing the composition in the air, and can be difficult for the user to implement when applying makeup to a small area.

There exists a need to remedy all or part of the drawbacks of known applicators and methods of applying makeup, whether it be for applying makeup or a care product to the eyelashes, the nails, the skin, or any other region of the body.

In one of its aspects, the invention seeks to satisfy that need.

U.S. patent application No. 2002/0084707, Japanese patent applications JP 02-059121 and 2003/164473, international application WO 94/09679, and U.S. Pat. Nos. 4,011,616, 5,189,751, 5,263,218, and 5,476,384 describe electric toothbrushes, and including a source of vibration. Those electric toothbrushes are not for applying a makeup composition.

International applications WO 02/072042 and WO 92/21306, and U.S. Pat. Nos. 5,187,827 and 6,139,553 describe devices for cleansing and treating the skin that are also not for applying a makeup composition.

U.S. Pat. No. 5,299, 354 describes a vibrating razor.

British patent GB 846 639 describes a method and a device for applying makeup to, and removing it from, the face. The apparatus disclosed in that patent comprises an electric vibration-generator comprising an electromagnet that is excited by the alternating current (AC) of the electricity network to which the apparatus is connected by a cord.

U.S. Pat. No. 3,030,647 discloses a device in which the vibration generator comprises an electric motor including an eccentric cam acting on a lever secured to a member carrying the applicator element.

U.S. Pat. No. 3,754,548 discloses a fluid dispensing vibrator with a skin vibrating element. A fluid reservoir is provided with a plurality of dispensing ball valves for dispensing fluids therefrom.

U.S. Pat. No. 5,622,192 discloses a comb comprises a spraying and managing device for spraying hair product and managing the hair.

SUMMARY

In a first of its aspects, the invention provides a method of applying makeup, the method including the step of applying makeup by means of a vibrating applicator. The method may be implemented so as to apply makeup to keratinous fibers, in particular the eyelashes or a lock of hair, and it thus makes it possible to obtain better separation of the eyelashes, and/or, when using a composition containing fibers, to obtain better orientation of said fibers, and/or make it easier to pick up composition on the applicator.

The method also makes it possible to obtain a smoother and glossier deposit of composition on the eyelashes or on a lock of hair.

In this aspect of the invention, the method may also be implemented so as to apply a composition to the nails, the skin, or the lips, and may thus make it possible to deposit a thicker and/or smoother layer of composition, in particular with a smaller risk of stripes forming on the nail.

Glossiness and coverage can be increased in this way.

The presence of vibration can also make it possible to obtain a thicker deposit of composition.

The vibration can also increase the adherence of the composition on the treated surface, e.g. for a lipstick or a nail varnish.

In addition, for application to the nails, the invention can enable thicker and/or more rigid bristles to be used to apply the composition, without a corresponding increase in the formation of stripes on the nail. By way of example, the invention can thus make it possible to reduce the number of bristles in the brushes used to apply the nail varnish.

The vibration can also make it easier for the composition to reach the applicator element, in particular when the applicator includes a supply of composition that feeds the applicator element.

The invention may also enable the composition to be spread more easily over the surface to be treated.

For a blusher, for example, the invention can make it possible to obtain color that is very uniform, and for an eyeshadow or an under-eye dark-circle concealer, the invention can make it possible to obtain a deposit that is more uniform.

The applicator may be used to apply the composition to a region that is to be made up.

The composition may be applied hot and/or cold.

The applicator may also be used to provide finishing touches to a region that has already been made up or that has already been supplied with composition by means of another applicator.

The composition may be taken from a receptacle by immersing the applicator element in said receptacle. While taking makeup, the applicator element may be subjected to the vibration of the vibrating source, thereby making it possible for the composition to be loaded in more uniform manner on the applicator element.

When the receptacle includes a wiper member through which the applicator element is removed, the applicator element may also be subjected to vibration while passing through the wiper member, thereby making it possible to wipe the applicator element in a way that is different than the way it is wiped when it is not vibrating. By way of example, the user may thus choose between at least two degrees of wiping the applicator element, depending on whether or not the applicator element is vibrating while passing through the wiper member.

Furthermore, it is more advantageous to cause the applicator to vibrate rather than the wiper member, since the vibration of the applicator may also be useful during application.

The wiper member could present an opening that is considerably larger than the stem, if any, carrying the applicator element.

Independently of the kind of applicator element and of the kind of composition to be applied, the method may include the step of the user setting a vibration frequency and/or setting a vibration amplitude, e.g. by acting on a control member.

During application, the vibration amplitude of the applicator element is not greater than 5 millimeters (mm), for example, and better not greater than 3 mm, with microvibration of the applicator element being preferable to vibration of greater amplitude.

The amplitude of the vibration is optionally greater while the composition is being taken from a receptacle or while the applicator member is passing through a wiper member.

The vibration may be obtained in various ways, e.g. mechanically, hydraulically, pneumatically, electronically, or electromechanically.

By way of example, the vibration source may comprise a motor driving a flyweight, or an eccentric, or it may comprise an electromagnet, or a piezoelectric or mechanical vibrator.

The motor may be powered by an optionally rechargeable battery.

The contact between the vibration source and the rest of the applicator portion could be point contact, or contact over an extended area, e.g. depending on the amplitude, frequency, and orientation desired for the vibration.

By way of example, the method may include adjusting the position of the vibration source relative to the rest of the applicator portion, so as to modify the nature of the contact between them, so that in one configuration, vibration having a certain orientation and/or a certain amplitude is transmitted to the applicator element or to the applicator portion, and in another configuration, vibration having another orientation and/or amplitude is transmitted.

The frequency of the vibration is not less than 20 hertz (Hz), for example.

The vibration may be oriented transversally to the longitudinal axis of the applicator element or parallel thereto, or it may be oriented in some other way.

The method may include mounting a vibrator unit on an applicator portion. This makes it possible to use a vibrator unit in association with different applicator portions, in order to treat different regions of the body depending on the applicator portions selected.

The applicator portion may optionally include a closure element for closing a receptacle containing the composition to be applied.

The method of applying makeup may include applying a makeup composition to certain parts of the body or of the face while causing the applicator element to vibrate, and to other parts of the body or of the face without causing the applicator element to vibrate, so as to obtain different makeup effects, e.g. different degrees of glossiness.

The method may also include loading the applicator element with composition, when said composition is in the form of compacted powder, by causing the applicator element to vibrate in contact with the powder.

In one exemplary embodiment of the method, the user applies the makeup by holding the applicator more or less firmly, depending on the amplitude desired for the vibration. By holding the applicator portion very firmly, the amplitude of the vibration tends to reduce, whereas by holding the applicator portion loosely, the amplitude of the vibration tends to increase. The user can thus obtain different makeup effects, depending on the way in which the applicator is held.

The applicator element may be magnetic.

In another of its aspects, the invention also provides a method of applying a cosmetic composition to keratinous materials with a view to forming a visible deposit on said keratinous materials, the method comprising:

i) forming a deposit of the cosmetic composition on the keratinous materials;

ii) simultaneously while forming the deposit, or after it has been formed, subjecting said deposit to a vibratory movement; and iii) leaving the deposit on the keratinous materials, where it can dry.

By way of example, the composition is deposited on: keratinous fibers, in particular the eyelashes, the eyebrows, or the hair; the lips; the nails; the eyelids; the contour of the eyes; the face; and/or the body.

The method may appear very advantageous for applying a composition to the nails, the lips, or keratinous fibers such as the eyelashes or the eyebrows.

In another of its aspects, the invention also provides a kit comprising:

a supply of a makeup composition; and an applicator for applying the composition coming from the supply of composition, the applicator comprising an applicator element, and further comprising a vibration source making it possible to cause the applicator element to vibrate.

By way of example, the makeup composition is a composition for applying to: the nails; the skin; keratinous fibers, in particular the eyelashes, the eyebrows, or the hair; or the lips, e.g. a mascara, a nails varnish, a lipstick, a lipgloss, a foundation, a blusher, an eyeshadow, an eye-contour concealer, an eyeliner, an under-eye dark-circle concealer; or a self-tanning agent, this list not being limiting. The composition is different from a toothpaste and from a body-scrub, and in particular it may contain pigments, in particular inedible pigments. The invention may be useful when the product to apply has a high viscosity. The vibrations can improve the application when the product has a high viscosity.

The composition may contain fibers, glitter, or other macroscopic elements.

The composition may present magnetic properties, where appropriate.

In those aspects of the invention in which any composition may be applied, and not necessarily a makeup, the composition may be, for example: a care product, in particular a blemish concealer, an anti-wrinkle cream, an under-eye puffiness concealer, a body lotion, or a root treatment substance, in particular for encouraging the growth of hair.

The applicator element may be arranged to apply a composition to the eyelashes or the hair, and it may comprise a brush or a comb, for example.

The brush may comprise a twisted core, with bristles that are held between the turns of the core, or it may be made in some other way.

By way of example, the comb is made as a single part by molding a plastics material.

In an exemplary embodiment of the invention, the applicator element comprises a brush for applying composition to the nails, the lips, or the skin.

The applicator element can also include a capillary applicator that is configured to retain the composition by capillarity, and that comprises, for example, a tubular wall, and an internal element that co-operates with the tubular wall to define a space for retaining the composition by capillarity. Such an applicator element may be useful for applying a composition to the nails, for example.

In another embodiment of the invention, the applicator element includes threads or a succession of annular stripes that are formed by a stack of disks, for example. Such an applicator element may be used for applying the composition to keratinous fibers.

In another exemplary embodiment of the invention, the applicator element comprises an endpiece, in particular a flocked endpiece, that is optionally elastically deformable.

In an exemplary embodiment of the invention, the applicator element comprises an elastically compressible member, such as foam, for example.

In another exemplary embodiment of the invention, the applicator element comprises a felt-tip.

In some exemplary embodiments, the applicator element is mounted at the end of a stem, which may be flexible, which can contribute to increasing the amplitude of the vibration of the applicator element and/or to increasing comfort in application.

The applicator may optionally include a reservoir of composition.

When the applicator does not include a reservoir of composition, the composition is contained in a receptacle, and the applicator element is loaded with composition by being inserted, at least in part, into the receptacle. The receptacle may optionally include a wiper member.

The vibration source may reside in the applicator, or, in a variant, it may form part of a vibrator unit that is suitable for being fastened in removable manner onto an applicator portion of the applicator.

The kit may thus comprise a vibrator unit, and a plurality of applicator portions that are associated with different compositions or different applicator elements.

By way of example, the kit may comprise a vibrator unit, and at least two applicator portions selected from the applicator portions for applying makeup or a care product to the eyelashes, the lips, the nails, the hair, or the skin, in particular the skin of the face and/or the skin of the body.

The possibility of using a common vibrator unit with at least two different applicator portions makes it possible to reduce cost and make the kit more compact.

In another of its aspects, the invention also provides an applicator for applying a composition to keratinous fibers, e.g. the eyelashes, or the hair, in particular a makeup composition or a care product for keratinous fibers, the applicator comprising an applicator element configured to apply a composition to keratinous fibers, and a vibration source making it possible to cause the applicator element to vibrate. By way of example, the applicator element may be a brush or a comb.

In another of its aspects, the invention also provides an applicator for applying a composition to the nails, the applicator comprising an applicator element configured to apply the composition to the nails, and further comprising a vibration source making it possible to cause the applicator element to vibrate. By way of example, the applicator element may be a brush or a capillary applicator element.

In another of its aspects, the invention also provides an applicator for applying a composition to the lips, the applicator comprising an applicator element configured to apply the composition to the lips, and further comprising a vibration source making it possible to cause the applicator element to vibrate. By way of example, the applicator element may be a flocked endpiece.

In another of its aspects, the invention also provides an applicator for applying a composition to the skin, e.g. a makeup composition or a care product, the applicator comprising an applicator element that is elastically compressible and/or porous, e.g. comprising an optionally-flocked foam or elastomer; the applicator further comprising a vibration source making it possible to cause the applicator element to vibrate, the applicator being configured to be fastened onto a receptacle containing the composition to be applied.

In another of its aspects, the invention also provides an applicator for applying a composition to the skin, e.g. a makeup composition or a care product, the applicator comprising an applicator element that is elastically compressible and/or porous, e.g. comprising an optionally-flocked foam or elastomer; the applicator further comprising a vibration source making it possible to cause the applicator element to vibrate, and the applicator further comprising a reservoir containing the composition to be applied.

The reservoir may be fastened in optionally removable manner onto the applicator. When the reservoir resides on the applicator so as to supply said applicator with composition, the wall of the reservoir may serve as the handle for the applicator, for example.

The invention also provides a kit comprising an applicator portion for applying a composition to keratinous materials, the kit further comprising an applicator element configured to apply the composition to the keratinous materials, a vibration source making it possible to cause the applicator element to vibrate, and a reservoir containing the composition to be applied to the keratinous materials.

In another of its aspects, the invention also provides a kit comprising at least two different applicator elements suitable for mounting selectively on the applicator, said applicator including a vibration source.

By way of example, the kit comprises a plurality of different applicator portions and a removable vibrator unit, or a plurality of applicator elements arranged to be mounted on a portion of the applicator containing the vibration source.

The applicator may comprise means to switch on/off the vibrator unit, for example a manual switch, which enables to consume less power.

The applicator device may comprise an applicator element fixed to a rigid stem.

The packaging and applicator device may comprise a compact comprising a vibrator unit. The latter can be attached to a bottom end of the compact, for example.

The applicator device may comprise a deformable wall that the user may press to switch on the vibrator. This deformable wall may be molded with a part of a case containing at least one battery and the vibrator.

The applicator may comprise a case comprising a button that is integrally molded with at least a part of the case. The button may be linked to said part of the case by a film hinge.

The button may carry a contact plate that is configured to contact another electrical element when the button is depressed, for example is configured to contact a battery.

The applicator may comprise a case comprising a base part and a cover linked together by a film hinge.

The packaging and applicator device may comprise a case having at least one housing for accommodating the applicator device when not in use and at least one housing for containing one product to be taken up by the applicator.

The applicator element may be connected to the applicator device in a removable manner.

The applicator element may be connected to the applicator device in a retractable manner. The applicator element may be pivotably connected to a body of the applicator device.

The latter may comprise a buttom which may be depressed to release the applicator element.

A spring may bias the applicator element towards a released position.

The applicator device may comprise a buttom that may be depressed to switch on the vibrator. This buttom may be molded integrally with at least one part of the case containing the vibrator and/or at least one battery of the device.

The applicator device may comprise a finishing member device that may be fixed to the applicator after having dispensed product on the keratinous materials with the applicator. This finishing member may be supported by a closure cap for the applicator.

The applicator may comprise a dispenser that may comprise a piston sliding in a reservoir containing the product. The piston may be displaced in response to a rotation of a knurl.

In a exemplary embodiment, the device comprises a pencil which is connected to the vibrator unit, for example in a releasable manner. The latter may comprise a housing in which the pencil is frictionnaly held. The housing may be defined between a plurality of tongues of the vibrator unit.

BRIEF DESCRIPTION OF THE DRAWINGS

The invention can be better understood on reading the following detailed description of non-limiting embodiments thereof, and on examining the accompanying drawings, in which:

FIG. 10 shows a kit comprising a plurality of different applicator elements that can be used with a vibrator unit;

FIG. 11 is a diagram showing one possibility of assembly between an applicator element and its associated stem;

FIG. 12 is a diagram showing another kit comprising a plurality of applicator portions and a common vibrator unit;

FIGS. 17 to 23 show various examples of applicator portions with their corresponding receptacles;

FIGS. 27 and 28 are diagrammatic and fragmentary longitudinal sections of two other examples of devices made in accordance with the invention;

FIGS. 33 and 34 are fragmentary and diagrammatic longitudinal sections of two examples of assembling the vibrator unit with the applicator portion, so as to transmit vibration in different ways, FIGS. 35 to 37 show various examples of applicator portions and corresponding stems, FIGS. 38 to 41 are fragmentary and dragrammatic views of a packaging and applicator devices made in accordance with the invention, FIG. 44 shows a packaging and applicator device for dispensing a stick of product, FIG. 45 is a diagrammatic and fragmentary view of an applicator device, FIG. 46 is a front view of another example of an applicator device made in accordance with the invention, and FIGS. 47 to 49 show another variants of packaging and applicator devices in accordance with the invention.

DETAILED DESCRIPTION

Figure 2:
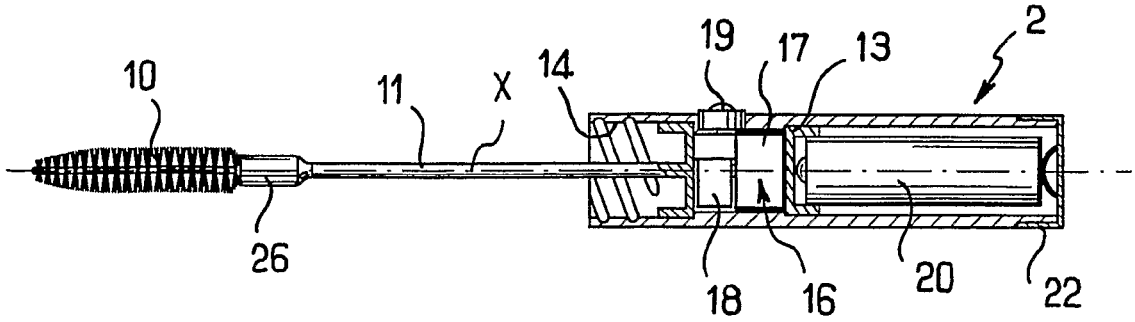
FIG. 2 is a fragmentary and diagrammatic longitudinal section of the FIG. 1 applicator shown in isolation.
Figure 1:
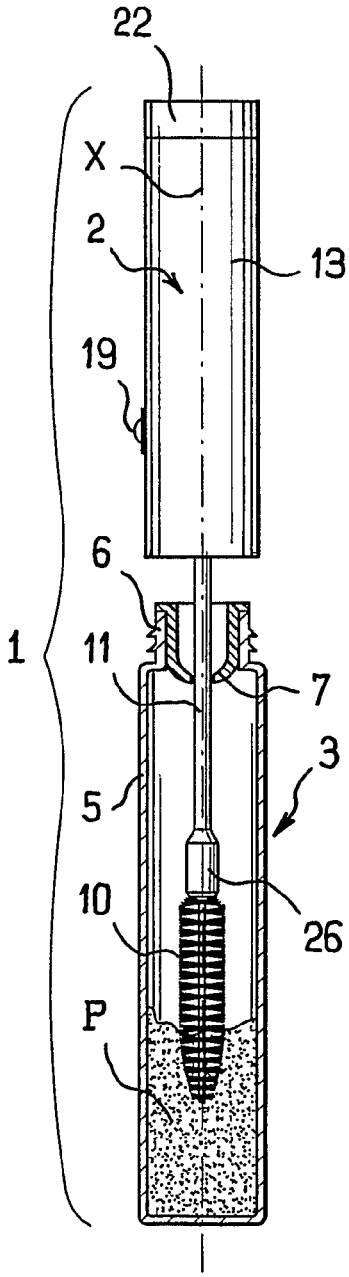
FIG. 1 is a diagrammatic and fragmentary longitudinal section of a packaging and applicator device constituting an exemplary embodiment of the invention.

FIGS. 1 and 2 show a packaging and applicator device 1 comprising an applicator 2, and a receptacle 3 containing a supply of a makeup composition P, in this event a composition for applying to keratinous fibers, e.g. mascara.

In the embodiment shown, the receptacle 3 is conventional and comprises a body 5 provided with an externally-threaded neck 6. A wiper member 7 is secured in the neck 6.

The applicator 2 includes an applicator element 10 that is constituted by a mascara brush in the embodiment under consideration. The applicator element 10 is mounted at the end of a stem 11 having its other end secured to a casing 13 including an end portion 14 that is arranged to be screwed onto the neck 6, and thus close the receptacle 3 in leaktight manner.

The casing 13 houses a vibration source making it possible to cause the applicator element 10 to vibrate while the makeup composition is being applied and/or while the composition is being taken from the receptacle and/or while the applicator element is being extracted.

In the embodiment under consideration, the vibration source comprises a vibrator 16 that is made up of a motor 17, and a flyweight 18 that is rotated by the motor and that has a center of gravity that is eccentric relative to the axis of rotation. The motor 17 is electrically powered by an energy source 20, such as a round battery for example, housed in the casing 13 in the embodiment under consideration, and electrically connected to the motor by a switch 19.

The casing 13 includes a removable cap/end piece 22 enabling the battery 20 to be put into place and to be replaced, and providing electrical contact with said battery.

In the embodiment under consideration, the axis of rotation of the motor 17 substantially coincides with the longitudinal axis X of the applicator, such that the vibration is produced substantially perpendicularly to the axis X.

Figure 3:
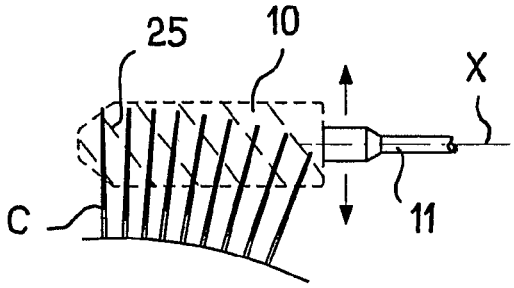
FIG. 3 shows the eyelashes being made up by means of a vibrating mascara brush.

The vibration propagates along the stem 11 and causes the applicator element 10 to vibrate substantially perpendicularly to the axis X while the composition is being applied to the eyelashes, as shown in FIG. 3.

In this figure, the brush is shown in very diagrammatic manner so as to make it clear that the invention is not limited to any particular applicator element.

By way of example, the brush 10 comprises bristles having ends that are disposed as helical layers 25. The oscillation of the brush 10 makes it possible to obtain relative movement of the bristles of the brush 10 along the eyelashes C, and thus makes it possible to smooth the composition over the surface of said eyelashes, and/or to orientate fibers optionally contained in the composition P. The vibration of the brush 10 can also make it easier to separate the eyelashes.

The motor 17 can be switched on while the composition is being applied to the eyelashes, whether it be during the initial application of the composition, or after said initial application in order to finish off making up.

The user can also cause the brush to vibrate when it is plunged into the receptacle 3, e.g. so as to make it easier to load the brush with composition, e.g. to obtain a more uniform load.

Figure 4:
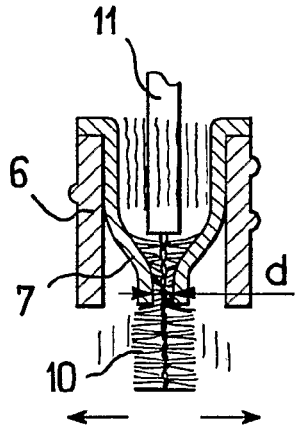
FIG. 4 shows a vibrating mascara brush passing through a wiper member.

The user can also cause the brush 10 to vibrate when it passes through the wiper member 7, as shown in FIG. 4.

The stem can be made with a cross-section that is constant or otherwise.

Thus, in the embodiment in FIGS. 1 and 2, the distal end of the stem includes an endpiece 26 that is used to secure the applicator element 10, and said stem presents a solid section that is relatively narrow over a major fraction of its length.

In the embodiment in FIG. 4, the stem is shown having an outside section that is substantially constant up to its distal end.

By way of example, the vibration of the brush makes it possible to use a wiper member 7 having a wiper orifice that presents an inside diameter d that is substantially greater than the diameter of the stem 11, e.g. more than 20% greater than the average diameter of the portion of the stem that passes therethrough. Thus, depending on whether or not the applicator element is caused to vibrate while it is being removed from the receptacle, the user can obtain an applicator element that has been wiped to a greater or lesser extent and that carries a different quantity of composition. Naturally, and in conventional manner, a wiper member can also be used that is of smaller diameter, corresponding to the diameter of the stem to be wiped.

The stem 11 is preferably flexible, which can increase the amplitude of the vibration of the brush 10, with the person skilled in the art being able to select the dimensions of the stem as a function of the kind of applicator element, the composition, and the treatment to be performed, for example.

The composition can be taken other than by plunging the applicator element into a receptacle containing the composition.

Figure 5:
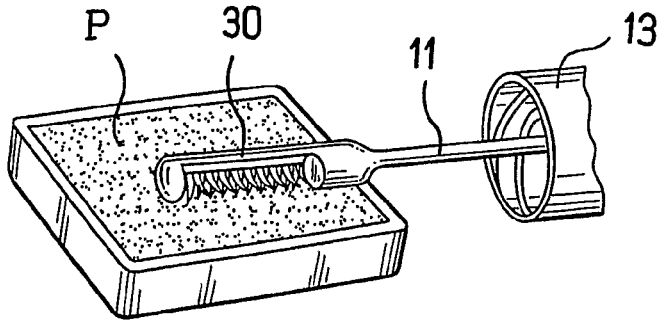
FIG. 5 shows composition being taken from a cake.

By way of example, FIG. 5 shows the possibility of taking the composition by bringing the applicator element into contact with a cake of composition.

In this figure, the applicator element is constituted by a comb 30 for applying to the eyelashes, the eyebrows, or the hair, in particular for treating a lock of hair.

By way of example, the comb 30 comprises projections forming V-shaped channels between them when the comb is observed in a direction that is perpendicular to its longitudinal axis.

By way of example, the comb used can be one of the combs described in U.S. publications Nos. 2003-0089379-A1, U.S. Pat. Nos. 6,655,390, 6,814,084, 6,675,814, 6,581,610, 6,546,937, 6,539,950, 6,412,496, and 6,343,607, 5,086,793, this list not being limiting.

The invention is not limited to a particular applicator element, and in particular said applicator element can be provided with means that make it possible to heat the composition and/or the eyelashes during application.

Figure 6:
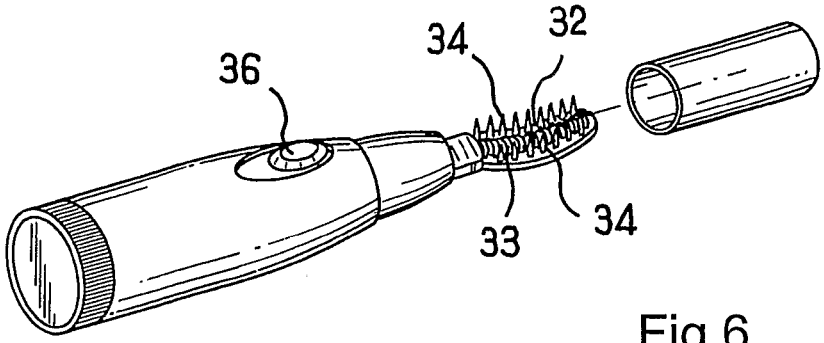
FIG. 6 is a diagrammatic perspective view of both a heater and vibrator applicator for applying composition to the eyelashes.

FIG. 6 shows an applicator element 32 that includes, for example, two rows of projections 34, and a heater element 33 between them.

The device can include a switch 36 that can, for example, take up a plurality of positions, of which one corresponds to heating only, for example, and the others correspond to vibrating only, or to heating and vibrating simultaneously.

The invention is not limited to a makeup composition for applying to keratinous fibers.

Figure 7:
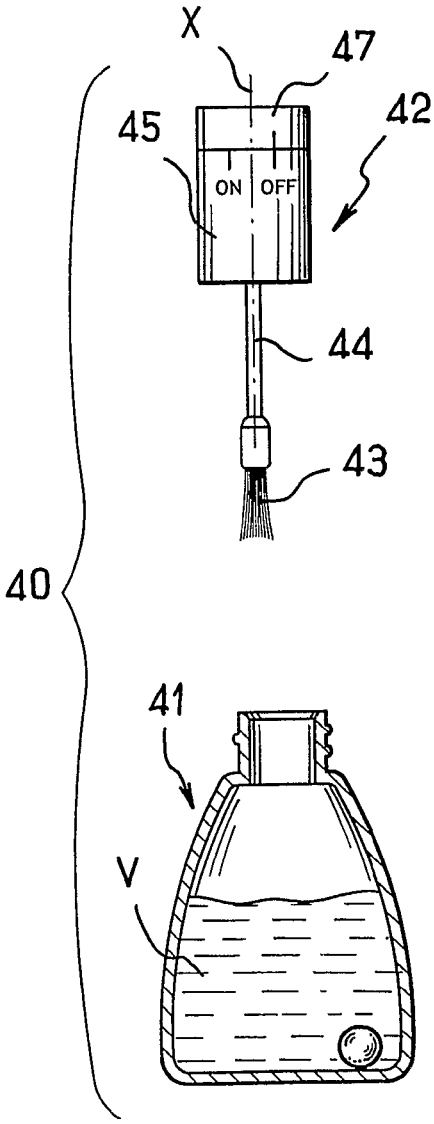
FIG. 7 is a fragmentary longitudinal section in elevation of another example of a packaging and applicator device.
Figure 8:
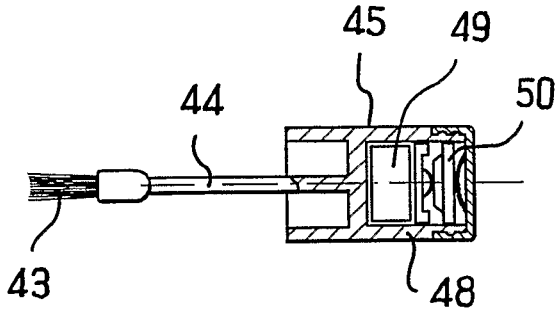
FIG. 8 is a fragmentary axial section of the FIG. 7 applicator shown in isolation.
Figure 9:
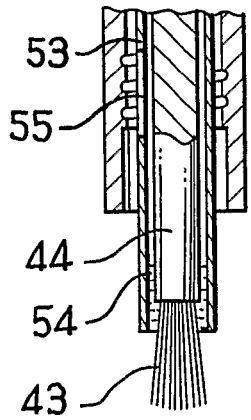
FIG. 9 is a diagrammatic and fragmentary view of a variant embodiment of the applicator.

By way of example, the makeup composition can also be for applying to the nails, as shown in FIGS. 7 to 9.

The device 40 shown in FIG. 7 comprises a receptacle 41 containing a varnish V for applying to the nails, and an applicator 42 comprising an applicator element 43 constituted by a brush, for example, mounted at the end of a stem 44 of longitudinal axis X, that is supported by a casing 45 that serves as a handle, as a closure element for closing the receptacle 41, and as a casing for housing a vibration source making it possible to cause the brush 43 to vibrate during use.

By way of example, and as shown, the casing 45 includes a cap/end piece 47 that can turn relative to the body 48 of the casing, so as to take up two positions, respectively ON and OFF, for a vibrator 49 housed in the body 48.

FIG. 8 shows the possibility of using at least one button cell 50 as the energy source.

In this exemplary embodiment, and by way of example, the vibrator 49 is a piezoelectric vibrator that is disposed in the casing 45 in such a manner as to subject the brush 43 to transverse or longitudinal vibration, depending on the desired makeup effect.

By way of example, the vibrator 49 is switched on, then the composition is taken from the receptacle 41 and applied to the nails. The vibration of the brush 43, in particular when transverse to the axis X, makes it possible to deposit a thicker layer of composition, and it also makes it possible to reduce the risk of stripes forming on the nail when the bristles of the brush are moved over its surface. The layer deposited can be glossier and more uniform.

Other applicators for applying composition to the nails can be used, and in particular, as shown in FIG. 9, an applicator in which the stem is surrounded by a sheath 53 co-operating with the stem 44 to form a gap 54 in which the composition can accumulate. At least one opening 55 can be formed in the sheath so as to enable air to enter, thereby making it easier for the composition contained in the gap 54 to flow onto the brush 43.

FIG. 10 shows the possibility of providing a kit comprising a vibrator unit 60 that can be selectively associated with a plurality of endpieces 61 to 64, each provided with a specific applicator element, and each for applying to different parts of the body or the face, for example.

The kit can comprise a case 67 housing the vibrator unit 60 and the various endpieces 61 to 64, and one or more receptacles 68 containing the compositions to be applied.

By way of example, the vibrator unit comprises a casing 13 for housing the FIG. 2 applicator, and differs therefrom by the fact that the end of the stem 11 is provided with a connector 70 that is capable of being coupled to one of the endpieces 61 to 64, e.g. by snap-fastening, as shown in FIG. 11, as a function of the composition to be applied.

FIG. 12 shows a variant embodiment of a vibrator unit 72 comprising: a casing 73 housing the vibrator and the electrical energy source; a switch 74 enabling the vibrator to be switched on; and a cap 75 making it possible to access the electrical energy source.

The vibrator unit 72 can include an endpiece 77 in which there can be inserted a stem 78 that is provided, at its end, with a specific applicator element, as shown in FIG. 12.

By way of example, the applicator element can be a comb 79 for the eyelashes, a brush 80, a mascara brush 81, a foam endpiece 82, a felt-tip 83, e.g. for applying eyeliner, a flocked endpiece 84, e.g. for applying composition to the lips, or a capillary applicator element 85. By way of example, the applicator element 85 is as described in U.S. Pat. No. 6,666,607.

The vibration created by the vibrating source can be useful in taking a composition in the form of a compacted powder, as shown in FIG. 28.

In the exemplary embodiment in this figure, the composition P is contained in a dish 193 housed in a receptacle 190 onto which the applicator 181 can be fastened.

By way of example, the applicator includes an applicator element 182 that is engaged inside the receptacle when the applicator is in place on said receptacle. The applicator element comprises a foam, for example.

The applicator element 182 comes into contact with the composition P that is present in the dish 193, said dish being pressed against the applicator element 182 by a resilient return member, e.g. a spring 191, that is interposed between the dish 193 and the bottom of the receptacle 190. When the vibration source 180 is switched on, e.g. by pressing on the switch 183, the vibration that is transmitted to the applicator element 182 enables the composition P to disintegrate, and the applicator element 182 to be loaded.

The stem 78 can include an annular flange 86 for snap-fastening in a corresponding groove 88 formed in the endpiece 77. By way of example, said endpiece is surrounded by an internally-threaded skirt 90 enabling a receptacle for protecting the stem 78 and its associated applicator element to be fastened onto the casing 73, or enabling the vibrator unit 72 to be fastened onto a receptacle containing the composition to be applied.

The vibrator unit can also be associated in other ways to an applicator portion.

By way of example, FIGS. 13 to 23 show various examples of devices that enable a common vibrator unit 95 to be used that comprises a casing 96 provided with a switch 97, and with a cap/end piece 98 enabling an electricity source 99 to be put into place in the casing 96. The casing houses the vibration source that comprises an electric motor 100, for example, that rotates a flyweight 101 about an axis of rotation that coincides with the longitudinal axis X of the vibrator unit.

When the user presses on the switch 97, the electric motor 100 is electrically connected to the battery 99 and rotates the flyweight 101, thereby generating vibration that is oriented transversally to the axis X.

Figure 16:
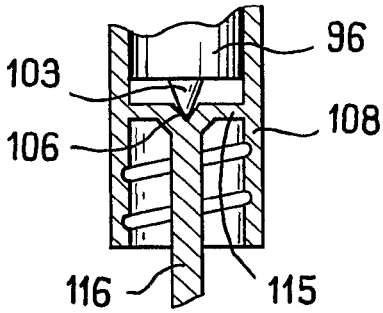
FIG. 16 is a diagrammatic and fragmentary view of an example of assembling the vibrator unit with the applicator portion.

On its end remote from the cap 98, the casing 96 can include a projection 103 for engaging in a housing 106 of the applicator portion 108, as shown in FIG. 16.

Figure 13:
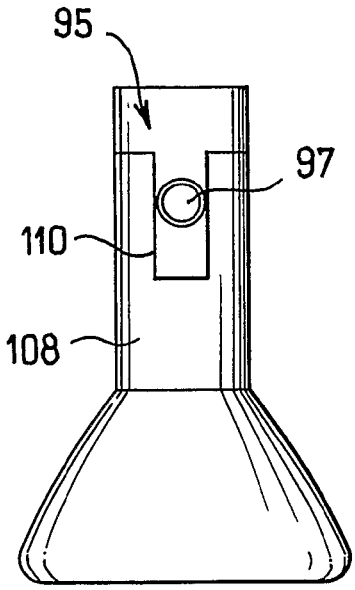
FIG. 13 shows another example of a packaging and applicator device having a removable vibrator unit.
Figure 14:
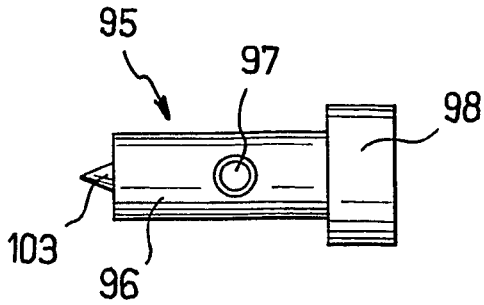
FIG. 14 shows the vibrator unit of the FIG. 13 device in isolation.
Figure 15:
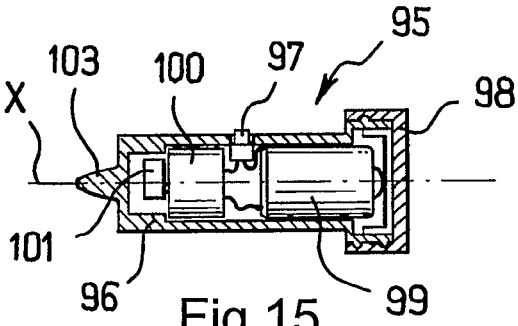
FIG. 15 is a diagrammatic and fragmentary longitudinal section view of the FIG. 14 device.

In the exemplary embodiment shown, the applicator portion 108 includes a window 110 in which the switch 97 can be engaged, as shown in FIG. 13.

The applicator portion 108 can include a transverse wall 115 to which the stem 116 carrying the applicator element is connected, and the housing 106 receiving the projection 103 can be adjacent to the stem 116, as can be seen in FIG. 16.

Figure 17:
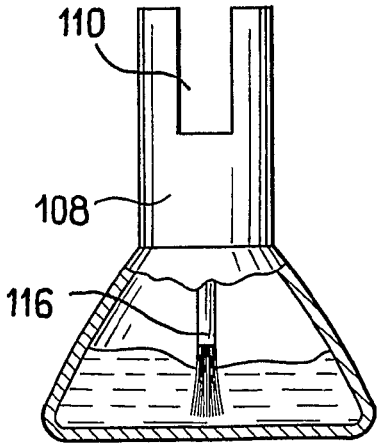
Figure 18:
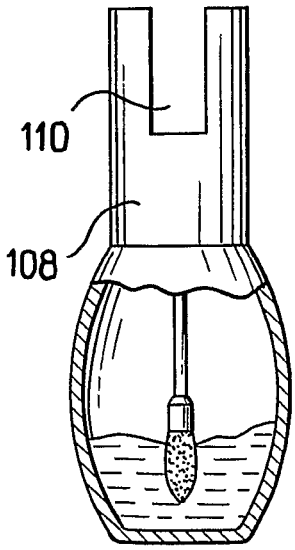
Figure 19:
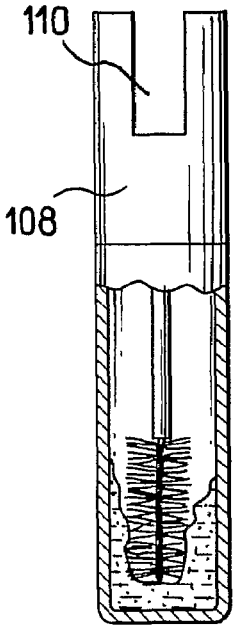
Figure 20:
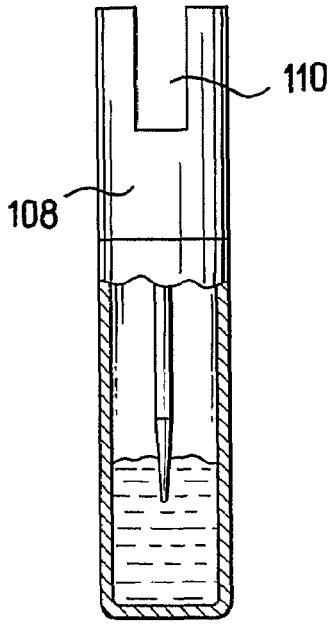
Figure 21:
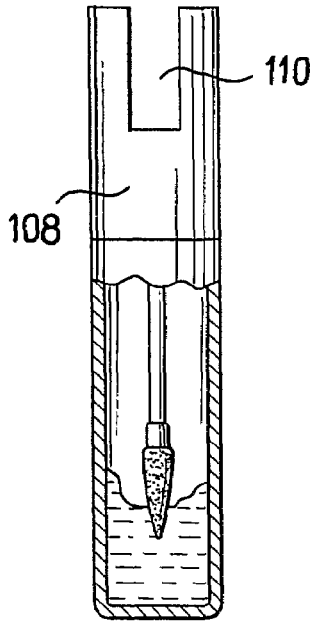

By way of example, the applicator portion 108 can be fastened onto: a receptacle containing a nail varnish, as shown in FIG. 17, the applicator element being a brush; a receptacle containing a liquid lipstick, the applicator element being a flocked endpiece, as shown in FIG. 18; a receptacle containing mascara, as shown in FIG. 19 or 22, the applicator element being a brush, a comb, or an applicator element comprising a helical thread or the like, for example; a receptacle containing an eyeliner, as shown in FIG. 20; or even a receptacle containing a care product for the eyelashes, as shown in FIG. 21.

Figure 23:
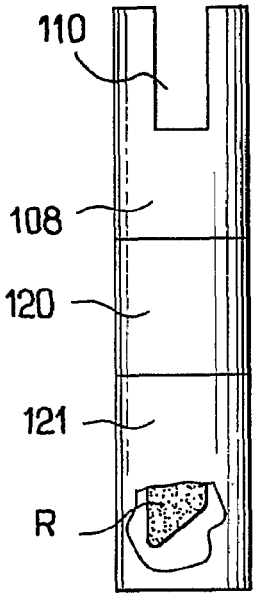
Figure 24:
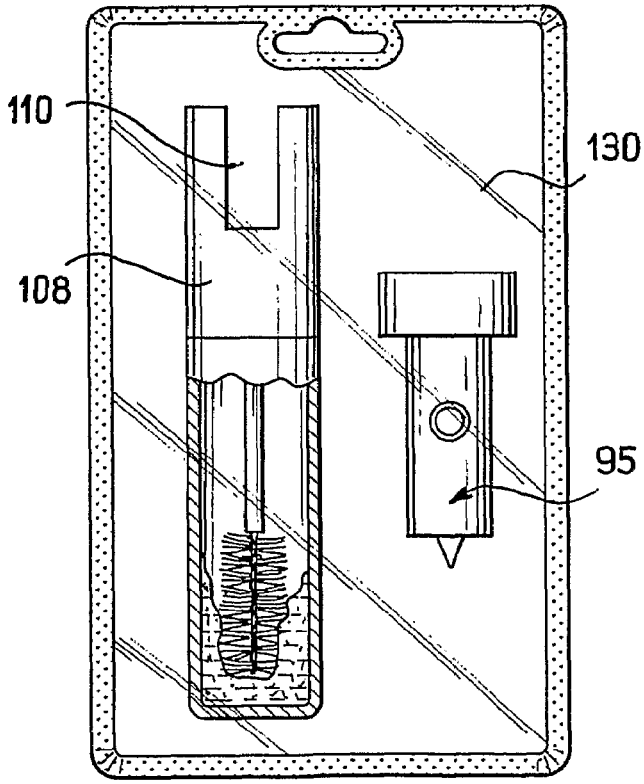
FIG. 24 shows packaging comprising a vibrator unit and a corresponding applicator portion.

The applicator portion can also comprise a stick of composition, e.g. a lipstick R, as shown in FIG. 23. By way of example, the applicator portion includes a mechanism for axially displacing the stick in response to a ring 120 being turned, and onto which a removable protective cap 121 can be fastened.

Where appropriate, the vibrator unit 95 can be packaged in packaging 130, e.g. of the blister type, with the applicator portion mounted on its associated receptacle, e.g. a receptacle containing mascara in the embodiment shown.

Figure 25:
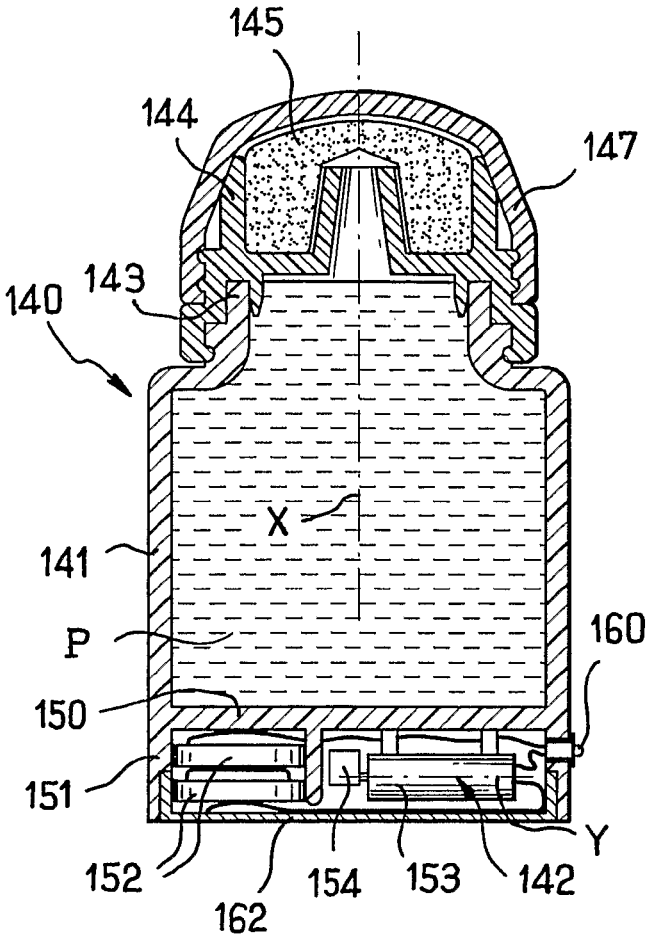
FIG. 25 is a diagrammatic and fragmentary longitudinal section of another example of a packaging and applicator device made in accordance with the invention.

FIG. 25 shows a device 140 that comprises a receptacle 141 containing the composition P to be applied, and a vibration source 142 that is secured to the receptacle 141 while in use.

In the embodiment under consideration, the receptacle 141 includes a neck 143 on which there is mounted a support 144 for supporting a porous applicator member 145, e.g. a foam. A protective cap 147 can be screwed onto the support 144. On the end remote from the neck 143, the receptacle 141 includes an end wall 150 that is extended downwards at its periphery by a tubular skirt 151 housing the vibration source. In the embodiment shown, the vibration source comprises an energy source that is constituted by button cells 152, and by an electric motor 153 that is capable of rotating a flyweight 154 about an axis of rotation Y that is substantially perpendicular to the longitudinal axis X of the receptacle 141. A switch 160 enables the motor 153 to be switched on.

The housing defined by the skirt 151 and by the end wall 150 can be closed by a cover 162 that is screwed or snap-fastened onto the skirt 151, for example. In the variant shown in FIG. 26, the vibration source belongs to a removable vibrator unit 170, the skirt 151 being provided so as to enable said unit 170 to be mounted or removed, thereby enabling said unit to be reused on another receptacle 141 once the first receptacle is empty.

The applicator element 145 is an open-cell foam, for example.

The composition P is a foundation or a care product, for example.

In use, the vibration can increase the flow of composition, and it can increase the thickness that is deposited on the skin.

Figure 27:
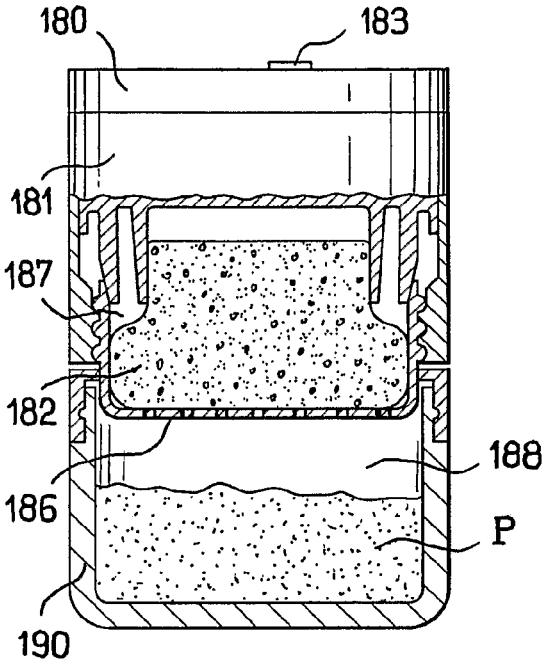

In the variant embodiment shown in FIG. 27, the device includes a vibration source 180 that can optionally be fastened in removable manner onto an applicator 181 carrying an applicator element 182 that is constituted by a foam, for example.

The vibration source can be switched on by a switch 183 that is provided on an end face of the applicator.

In the embodiment in FIG. 27, the applicator element 182 is loaded with the composition P through a perforated wall 186 that separates a housing 187 for receiving the applicator element when the receptacle is closed by the applicator, and a space 188 containing the supply of composition. The applicator is fastened onto the receptacle 190 by screw-fastening, for example.

Figure 29:
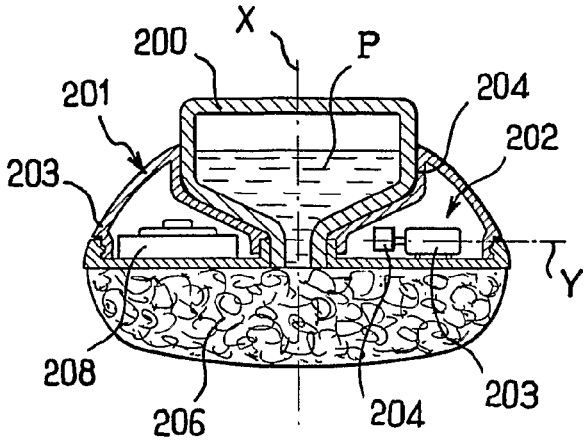
FIG. 29 is a diagrammatic and fragmentary longitudinal section of still another example of a packaging and applicator device made in accordance with the invention.

In the variant shown in FIG. 29, the device comprises a removable reservoir 200, and an applicator 201 housing a vibration source 202. By way of example, the applicator 201 comprises a shell 203 that is provided, at its center, with a housing 204 for receiving the receptacle 200 containing the composition P to be applied, which receptacle can supply, e.g. by capillarity, composition to an applicator element 206 that is, for example, constituted by a foam or any other porous element into which the composition can diffuse, e.g. a sintered element.

By way of example, the vibration source 202 comprises: a motor 203 that rotates a flyweight 204 about an axis Y that is perpendicular to the axis X of the receptacle 200; an electrical energy source 208; and a switch, not shown.

Figure 30:
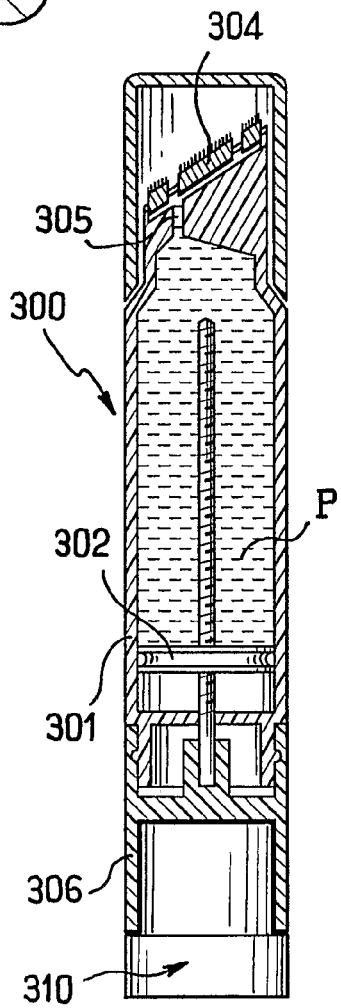
FIG. 30 is a fragmentary and diagrammatic longitudinal section of another example of an applicator for applying composition to the lips.

FIG. 30 shows an applicator 300 for applying a composition P to the lips.

The applicator includes a receptacle 301 in which there can slide a piston 302 that enables the composition to be forced towards an applicator element 304, that is constituted, in the embodiment shown, by a flocked part supplied by at least one internal channel 305.

The piston 302 is displaced by a drive portion 306 onto which a vibrator unit 310 can be fastened in optionally removable manner.

When said vibrator unit is in operation, the vibration that it generates can encourage the composition to adhere to the lips and increase the glossiness of the deposit that has been made.

By way of example, reference could be made to U.S. Pat. Nos. 6,688,317 or 5,879,095 which describe drive mechanisms of the piston in more detailed manner.

When the applicator includes a piston or any other mechanism that is displaced by the user acting on a control member such as a knurled wheel or a pusher, for example, the vibration source can be arranged in such a manner as to act as a control member.

For example, for an applicator including a piston that is displaced by turning a threaded drive rod, the vibrator unit can be arranged in such a manner that it can be coupled to the applicator portion, so that turning the vibration source relative to the applicator portion causes the piston to be displaced. By way of example, the vibration source can include a projecting or hollow portion in relief presenting a cross-section that is not completely circularly symmetrical, e.g. a polygonal section, and the applicator portion can include a portion in relief of complementary shape so as to enable torque to be transmitted when the vibration source is in place on the applicator portion.

Various modifications can be applied to the embodiments described above, without going beyond the ambit of the present invention.

For example, the vibration source can comprise a vibrator other than an electric motor rotating a flyweight, and other than a piezoelectric vibrator. In particular, the vibration source can comprise any electromechanical, pneumatic, hydraulic, mechanical, electronic, or electromechanical system that is capable of producing vibration.

The vibration source can comprise control means other than a simple ON/OFF switch for controlling the vibration, and in particular it can include mechanical or electronic control means making it possible to set the amplitude and/or the frequency of the vibration. By way of example, the control means can include a rotary or linear potentiometer or switch, making it possible to select at least two speeds of rotation for the electric motor when the vibrator includes such a motor.

Figure 31:
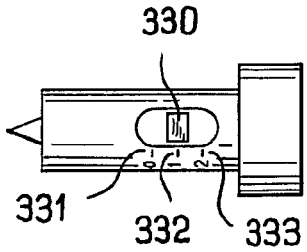
FIG. 31 is a view similar to FIG. 14 of a variant embodiment.

By way of illustration, FIG. 31 shows a vibrator unit provided with a selector 330 that is capable of taking up three positions, marked by identifiers 331, 332, and 333, that correspond respectively to the vibrator being OFF, to a medium vibration frequency, and to a higher frequency.

Figure 32:
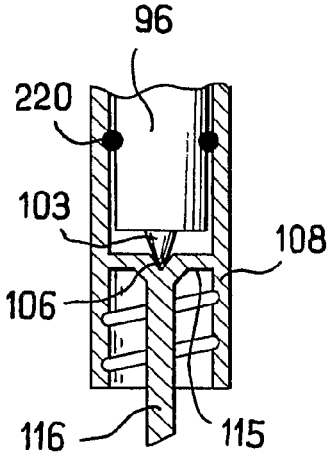
FIG. 32 is a view similar to FIG. 16 of a variant embodiment.

It can be seen in FIG. 32 that a gasket 220 can be interposed between the side surface of the vibration source and the facing wall of the housing of the applicator portion, so that the vibration of the vibrating source is transmitted essentially by the projection, for example.

The vibration source can comprise more than one vibrator, e.g. two vibrators that are arranged to produce oscillations in different directions. In this event, and by way of example, the vibration source can also include a selector making it possible to select the vibrator(s) that is/are to be used.

The vibration source can be arranged to be able to take up at least two positions relative to the rest of the applicator, so that for at least said two positions, the vibration transmitted to the applicator element is of different orientation and/or amplitude. This can enable the user to select one of the positions as a function of the kind of applicator portion, and/or as a function of the desired makeup effect, for example.

For example, the vibration source can be movable relative to the applicator portion, between a position in which one end of the vibration source comes to bear against the applicator portion, and another position in which said end does not come to bear against the applicator portion.

In addition, the vibration source can be in permanent contact with the applicator portion via at least one side surface.

By way of example, the vibration source can be moved relative to the applicator portion by means of threads 341 and 342 present on the vibration source and on the applicator portion, the user being able, in this event, to screw the vibration source to a greater or lesser extent into the applicator portion, so as to put its end optionally into contact with the applicator portion, as shown in FIGS. 33 and 34.

In FIG. 33, the vibration source is not fully screwed into the applicator portion, and the vibration is transmitted from the vibration source to the applicator portion only via the side surface of the vibration source.

In FIG. 34, the vibration source is in contact with the applicator portion both via its side surface and via its end.

The relative displacement of the vibration source and of the applicator portion can also be obtained other than by means of threads present on the vibration source and on the applicator portion, e.g. it can be obtained by means of a member that is movable relative to the applicator portion and to the vibration source, and that can be displaced by the user between a position in which it comes to bear against the vibration source, and another position in which it is at a distance from said vibration source.

The vibration source can also be pressed to a greater or lesser extent against the applicator portion by means of a member disposed on said applicator portion, e.g. a cap which, by being screwed to a greater or lesser extent onto the applicator portion, bears to a greater or lesser extent on the vibration source.

Where appropriate, the vibration source can be oriented by the user so as to cause the applicator element to vibrate with vibration of desired orientation.

The vibration source can include an energy source that can be other than a battery, and in particular it can include one or more rechargeable batteries or capacitors. Where appropriate, the vibration source can be arranged in such a manner that it can be recharged with electricity by being placed on a stand.

Where appropriate, the vibration source can be powered from the electricity network by means of an optional transformer.

The vibration source can be mounted in a variety of ways in a corresponding housing of the applicator, and the vibration source is mounted in such a manner as to encourage the transfer of vibration towards the applicator element.

By way of example, the vibration source is disposed in the applicator, with resilient damping means being interposed between the casing of the applicator and the vibration source, as shown in FIG. 32. The damping means comprise an elastomer gasket, for example.

In the embodiment in FIG. 32, the vibration is transmitted to the applicator element in particular by engaging one end of the vibrator unit in a housing of shape corresponding to the applicator portion.

The vibration source could be put into operation in still further ways other than those described above.

A switch having the shape of a pen clip could be used, or any other contactor disposed on the side or at the end depending on the type of application.

The applicator elements could be of any type, in particular having capillary slots or even slots of other kinds.

The applicator elements could be made in various ways, in particular by molding, overmolding, stapling, or twisting.

The applicator elements could be for single use only, where appropriate.

The applicator elements could be fastened to the applicator portion by any means, in particular by adhesive, heat sealing, stamping, snap-fastening, screw-fastening, with magnets, by friction, by VELCRO®-type fastening, or by clamping between jaws or the branches of a clip.

The composition can present any rheology and consistency. By way of example, the composition is a paste, a liquid, or a powder.

When the vibrator is an electric vibrator, its power supply voltage lies in the range 1 volt (V) to 9 V.

The use of button cells can be advantageous in making the vibration source more compact.

Where appropriate, the applicator element can be turned as described in U.S. Pat. Nos. 4,937,326, 4,922,934, and 6,565,276, for example.

Causing a mascara brush to vibrate while it is being turned, can reduce the risk of the eyelashes becoming trapped in the bristles.

When the invention is implemented inter alia to apply a composition to keratinous fibers, the composition can be applied after it has been heated, e.g. by putting it in a microwave oven.

FIG. 35 shows an applicator element 10 that can be releasably attached to the stem 11 of the applicator device.

The stem 11 may be rigid and the applicator element 10 may comprise a rod 400 that may be flexible.

The applicator element 10 may be attached to the stem 11 by a snap fastening or otherwise, for example by friction or screwing.

FIGS. 36 and 37 show variants in which the applicator element may comprise a mascara brush. The brush may comprise twisted wire core having an end portion 401 which is relatively rigid.

The stem 11 comprises an end portion 403 with an increased flexibility, in which the end portion 401 of the brush may be force fitted.

In the embodiment of FIG. 37, the stem 11 comprises an intermediate portion 406 with reduced diameter, so as to provide an increased flexibility to the stem 11. The latter may comprise proximal and distal portions which are rigid on each side of the intermediate portion 406.

The applicator element, whatever the way it is fixed to the applicator device, may comprise a brush made in accordance to any one of the FR 2 505 633, FR 2 562 773, FR 2 607 373, FR 2 607 372, FR 2 627 068, FR 2 627 363, FR 2 650 162, FR 2 663 823, FR 2 663 826, FR 2 607 373, FR 2 506 581, FR 2 529 765, FR 2 605 505, FR 2 625 083, FR 2 633 498, FR 2 637 471, FR 2 637 472, FR 2 648 686, FR 2 668 903, FR 2 668 905, FR 2 690 318, FR 2 685 859, FR 2 686 491, FR 2 675 355, FR 2 715 038, FR 2 706 749, FR 2 701 198, FR 2 724 095, FR 2 730 910, FR 2 733 398, FR 2 733 673, FR 2 738 127, FR 2 738 125, FR 2 745 481, FR 2 748 913, FR 2 749 490, FR 2 749 489, fr 2 753 056, FR 2 753 614, FR 2 755 593, FR 2 759 872, FR 2 759 873, FR 2 762 494, FR 2 774 269, FR 2 781 653, FR 2 796 531, FR 2 796 532, FR 2 800 586, FR 2 808 981, FR 2 811 525, FR 2 821 536, FR 2 821 533, FR 2 830 421, FR 2 831 033, FR 2 836 800, FR 2 838 936, FR 2 840 515, FR 2 840 514, FR 2 840 516, FR 2 847 436, FR 2 850 549, FR 2 851 435, FR 2 852 500, FR 2 855 380, EP 1 050 236, U.S. Pat. No. 6,295,994, U.S. Pat. No. 4,861,179, DE 101 02 219, DE 197 44 181, WO 96/19928, DE 38 35 843, DE 38 28 001, U.S. Pat. No. 4,586,520, EP 0 250 680, U.S. Pat. No. 5,086,793, FR 2 874 798.

When the applicator element is a twisted wire brush, a good result may be obtained when the wire has a relatively small diameter, for example a diameter about 0.33 mm, for example ranging from 0.25 to 0.45 mm.

The applicator element may also be different from a mascara brush, and for example may be an applicator element as disclosed in any one of the patents FR 2 685 925, FR 2 363 299, FR 2 490 470, FR 2 486 375, FR 2 500 730, FR 2 585 934, FR 2 588 733, FR 2 603 780, FR 2 412 287, FR 2 518 381, FR 2 544 970, FR 2 581 569, FR 2 711 898, FR 2 662 921, FR 2 629 988, FR 2 633 256, FR 2 633 167, FR 2 642 675, FR 2 642 676, FR 2 687 055, FR 2 679 113, FR 2 717 057, FR 2 701 818, FR 2 722 380, FR 2 722 381, FR 2 727 608, FR 2 729 060, FR 2 730 704, FR 2 734 131, FR 2 736 248, FR 2 745 272, FR 2 745 479, FR 2 752 696, FR 2 753 0587, FR 2 754 458, FR 2 761 959, FR 2 771 077, FR 2 779 924, FR 2 792 618, FR 2 793 218, FR 2 793 663, FR 2 796 529, FR 2 796 528, FR 2 796 527, FR 2 796 530, FR 2 808 980, FR 2 809 295, FR 2 809 294, FR 2 809 938, FR 2 810 860, FR 2 810 861, FR 2 812 176, FR 2 814 923, FR 2 815 832, FR 2 821 532, FR 2 825 246, FR 2 825 247, FR 2 836 031, FR 2 836 030, FR 2 836 029, FR 2 837 077, FR 2 839

625, FR 2 845 577, FR 2 850 257, FR 2 851 899, FR 2 852 796, FR 2 854 779, FR 2 855 379, FR 2 858 529, FR 2 863 460, FR 2 866 215, FR 2 868 669, FR 2 870 697, FR 2 872 394, FR 2 872 999, FR 2 860 769, FR 2 860 770, FR 2 869 511, FR 2 871 139.

FIG. 38 shows a packaging and applicator device comprising a compact 408 containing at least one cosmetic product 409 such as, for example, a powder or a paste and an applicator 412 to take up the product 409.

The compact may comprise a lid 413.

The compact may be configured to enable vibrator unit 420 to be coupled to the compact.

The vibrator unit 420 is, for example, configured to be connected to a bottom end of the compact.

The user may select to switch on the vibrator unit before taking up the product 409, in order, for example, to increase the load of product taken out by the applicator element.

The vibrator unit 420 may comprise switching means to enable the user to have the vibrator unit vibrate or not during use.

FIG. 39 shows another example of a packaging and dispensing device in which the applicator element 430 may comprise at least one opening 431 or slit to enable the product contained in receptacle to be dispensed on the outside surface of the applicator element 430.

The applicator element may comprise a plurality of openings located in a central region of the applicator element.

The applicator element may comprise a foam or a flocking.

The vibrator unit 440 may be located, for example, at the rear end of the device.

Switching means 450 may be provided.

The receptable may contain a powder.

The vibrations of the vibrator unit may facilitate the dispensing of the powder and/or may increase the quantity of powder that is deposited on the keratineous materials.

FIG. 40 shows a device comprising an applicator element made of a tuft of soft bristles 455.

The tuft of bristles may be protected when the device is not used by a removable cover 456 which may be configured to snap on the body 457 of the device.

The switching means 460 may be provided to enable the user to switch on the vibrator unit 465 which may be located at the rear end of the device.

Figure 41:
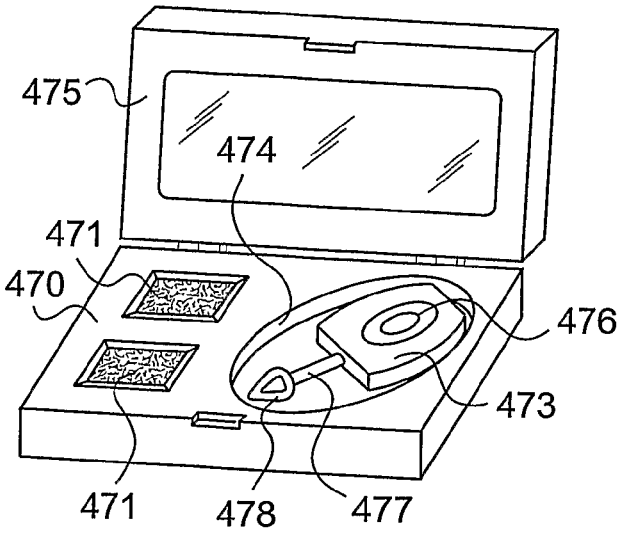
Figure 42:
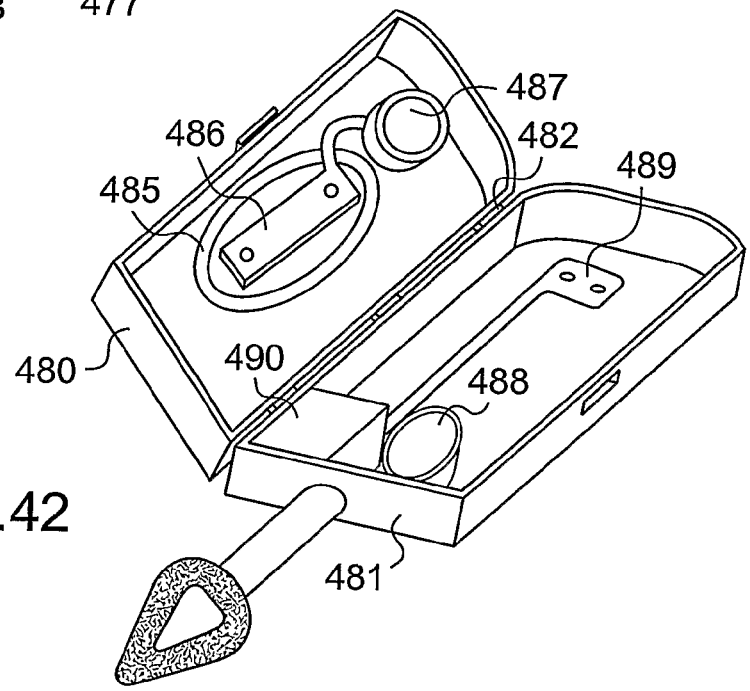
FIG. 42 shows an applicator device according to another exemplary embodiment of the invention, when the device is open.

FIG. 41 shows a packaging and dispensing device comprising a case 470 which may contain one or more products 471 and an applicator device 473.

The applicator device may be received in a housing 474 of the case when not in use.

The case may comprise a lid 475 which may be pivotably connected to the base portion of the case.

The applicator device 473 may comprise on one face thereof switching means 476 and may also comprise a stem 477 provided with an applicator element 478 at one end.

The applicator device 473 may comprise two parts 480 and 481 which may be connected by a hinge 482.

The switching means 476 may comprise a deformable wall 485 on the part 480, this deformable wall 485 carrying a contact plate 486 which may be connected to a battery 487.

The other part 481 may comprise another battery 488 and contact plate 489 configured so as to contact the battery 487 when the receptacle is closed.

When the user does not depress the deformable wall 185, the contact plate 486 does not contact the battery 488 and the vibrator 490 is not powered.

When the user depresses the deformable wall 485, the contact plate 486 is pressed against the battery 488 and the batteries 487 and 488 are electrically connected in series to the vibrator 490.

Figure 43:
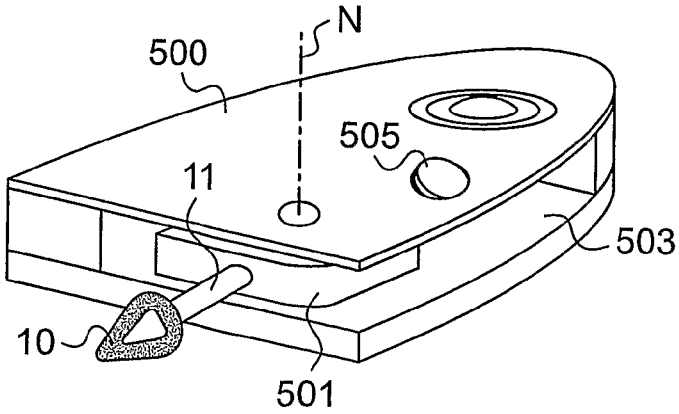
FIG. 43 shows an applicator device according an another exemplary embodiment.

FIG. 43 shows a variant in which the applicator element 10 is movable relative to a body 500 of the applicator device.

The applicator element 10 is, for example, connected to a stem 11 which is supported by a support 501 and which is rotatable around an axis N relative to the body 500.

The latter may comprise a housing 503 to accommodate the applicator element 10 when the latter is rotated by an angular movement of for example about 180°.

A button 505 may be provided on the applicator device so that when depressed, the applicator element is automatically released into the operating position. The support 501 may be rotated against biasing means such as a leaf spring (not shown).

FIG. 44 shows a packaging and dispensing device wherein the product is in the form of a stick 510 which can be moved thanks to a mechanism 511 comprising a knurl 520 which can be rotated relative to the body 521 of the device.

The mechanism 511 may comprise a screw and the stick 510 may be carried by a threaded cup engaging the screw and sliding in the body 521.

The knurl 520 may house a vibrator and may comprise a switch 525 to allow the user to switch on the vibrator unit when desired.

Figure 26:
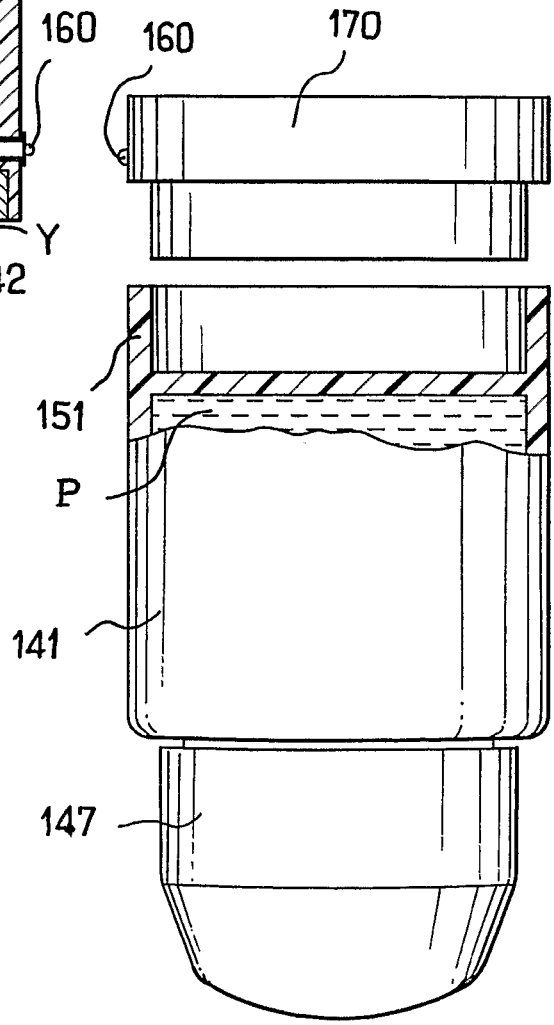
FIG. 26 is a diagrammatic and fragmentary longitudinal section of a variant of the FIG. 25 device, in which the vibrator unit is removable.

In a variant not shown, the vibrator unit is not located within the knurl 520 but is made as an independent portion and can be brought on the knurl, for example in a manner similar to what has been disclosed with reference to FIG. 26.

FIG. 45 shows an applicator device which comprises a base part 530 and a cover 531 which is for example snaped on the base part 530.

A button 533 may be made integral with the base part 530 by moulding thermoplastic material and connected to the wall of the base part 530 by a film hinge 535. The base part 530 may house a battery 540 and the button 533 may carry a contact plate 541 which may contact electrically the battery 540 when the button 533 is depressed.

The vibrator unit 550 may be housed in the base part, as shown.

The part 531 may comprise a rear wall 536 that faces at least partially the rear wall 537 of the base part 530 when the two parts are assembled together.

The applicator element may be fixed to a projection that may be located at a front end of the case.

In a variant shown in FIG. 46, the battery 540 is carried by the cover 531. The latter may be connected to the base part 530 by a film hinge 545.

FIG. 47 shows a packaging and an applicator device comprising a pencil 560, for example an eyebrow pencil or a lip liner, comprising a cosmetic product 565. The pencil 560 may be releasably connected to a vibrator unit 570 which may comprise a switch 571.

The vibrator unit 570 may comprise a plurality of tongues 573 to frictionably hold the pencil 560.

FIG. 48 shows a packaging and an applicator device comprising a lipstick dispenser 580 having, at one end, a knurl which may be rotated to displace within the dispenser a sliding piston (not shown).

The product may be dispensed trought at least one opening of an applicator element 583 made, for example, by a flocked endpiece.

A vibrator unit 585 may be connected to the knurl 581 or, in a variant not shown, may be integral therewith.

The dispenser may comprise a finishing element 601 that may be fixed on the dispenser 581 to improve the makeup. The finishing element 601 may be configured to contact the keratinous materials.

The finishing element 601 may be carried by a closure cap 600.

The dispenser 581 may be used without the closure cap 600 to apply the make up and during the application of the makeup, the vibrator unit may or not be switched on.

The appearance of the makeup may be improved by using the dispenser 580 with the closure cap 600 on to bring the finishing element 601 in contact with the made up zone. The vibrator unit may or not be switched on when the finishing element 601 is used.

FIG. 49 shows a mascara applicator comprising a dispenser 610 provided with an applicator element 620 configured to apply a product to the eyelashes or the eyebrows.

The product may be supplied to the applicator element 620 thanks to a piston sliding within the dispenser body 610 in response to the rotation of a knurl 630.

The dispenser 610 may comprise a vibrator unit 640 which may be releasably connected to the knurl 630.

In a variant not shown, the vibrator unit is integrated in the dispenser 610 in a non releasable manner.

Throughout the description, including in the claims, the expression "comprising a" should be understood as being synonymous with "comprising at least one" unless specified to the contrary.

What is claimed is:

1. A mascara unit comprising:

i) a mascara application unit comprising a handle; a rod having a proximal end and a distal end, the rod being coupled to the handle at the proximal end, the rod extending along a longitudinal axis X from the distal end to the proximal end; and an eyelash applicator member coupled to the distal end of the rod, the eyelash applicator member including a brush or a comb;

ii) a reservoir removably coupled to the mascara application unit and arranged to receive the rod and eyelash applicator member, the reservoir including a neck that includes an opening for the reservoir, said reservoir containing a mascara composition;

iii) a wiper member disposed in the neck of the reservoir, said wiper member having a first side and a second side opposite the first side, the first side of the wiper member being nearer to the opening than the second side is; and iv) a removable vibration unit including an electric motor, the removable vibration unit being removably mounted in the mascara application unit such that the electric motor causes an off-centered counterweight to rotate substantially around said longitudinal axis X, said electric motor being configured to cause the eyelash applicator member to vibrate at least as the eyelash applicator member passes from said second side of the wiper member to said first side of the wiper member.

2. The mascara unit according to claim 1, further comprising an end piece configured to removably abut the handle and to cover a cavity disposed within the handle.

3. The mascara unit according to claim 2, wherein the removable vibration unit further comprises a battery connected to supply electric power to the electric motor.

4. The mascara unit according to claim 3, wherein, when in a state in which the end piece is abutted to the handle, the battery is disposed, along the longitudinal axis X, between the end piece and the electric motor.

5. The mascara unit according to claim 2, wherein the removable vibration unit is removably disposed within the cavity.

6. The mascara unit according to claim 2, wherein the end piece is removably coupled to the removable vibration unit.

7. The mascara unit according to claim 2, wherein the end piece abuts the handle and separates from the handle by moving substantially along the longitudinal axis X.

8. The mascara unit according to claim 2, wherein the end piece, while in a state abutted to the handle, overlaps an entire profile of the handle when viewed along the longitudinal axis X.

9. The mascara unit according to claim 1, wherein the electric motor is electrically connected to a battery.

10. The mascara unit according to claim 9, further comprising an end piece configured to removably abut the handle and to cover a cavity disposed within the handle.

11. The mascara unit according to claim 10, wherein the removable vibration unit further comprises a battery connected to supply electric power to the electric motor.

12. The mascara unit according to claim 11, wherein the end piece is removably coupled to the removable vibration unit.

13. The mascara unit according to claim 11, wherein, when in a state in which the end piece is abutted to the handle, the battery is disposed, along the longitudinal axis X, between the end piece and the electric motor.

14. The mascara unit according to claim 10, wherein the removable vibration unit is removably disposed within the cavity.

15. The mascara unit according to claim 10, wherein the end piece abuts the handle and separates from the handle by moving along the longitudinal axis X.

16. The mascara unit according to claim 10, wherein the end piece, while in a state abutted to the handle, overlaps an entire profile of the handle when viewed along the longitudinal axis X.

17. The mascara unit according to claim 10, wherein an amplitude of the vibration of the eyelash applicator member perpendicular to said longitudinal axis X is no greater than 5 mm.

18. The mascara unit according to claim 10, wherein the removable vibration unit is movable substantially along the longitudinal axis X and is configured to connect to the handle by moving substantially along the longitudinal axis X toward the eyelash applicator member and is configured to be removed from the handle by moving substantially along the longitudinal axis X away from the eyelash applicator member.

19. The mascara unit according to claim 10, wherein the eyelash applicator member is caused to vibrate during application of the mascara composition to eyelashes.

20. The mascara unit according to claim 1, wherein the eyelash applicator member is a brush including a twisted wire core with bristles.

21. The mascara unit according to claim 1, wherein an amplitude of the vibration of the eyelash applicator member perpendicular to the axis X is no greater than 5 mm.

22. The mascara unit according to claim 1, wherein the removable vibration unit is movable substantially along the longitudinal axis X and is configured to connect to the handle by moving substantially along the longitudinal axis X toward the eyelash applicator member and is configured to be removed from the handle by moving substantially along the longitudinal axis X away from the eyelash applicator member.

23. The mascara unit according to claim 1, wherein the eyelash applicator member is caused to vibrate during application of the mascara composition to eyelashes.

* * * * *